US006387019B1

(12) United States Patent
Krull

(10) Patent No.: US 6,387,019 B1
(45) Date of Patent: May 14, 2002

(54) METHODS AND APPARATUS FOR ADJUSTING RESISTANCE TO EXERCISE

(76) Inventor: Mark A. Krull, P. O. Box 57, Greencastle, IN (US) 46135

( * ) Notice: Subject to any disclaimer, the term of this patent is extended or adjusted under 35 U.S.C. 154(b) by 0 days.

(21) Appl. No.: 09/687,676

(22) Filed: Oct. 13, 2000

Related U.S. Application Data

(63) Continuation-in-part of application No. 09/387,160, filed on Aug. 31, 1999, now Pat. No. 6,183,401, which is a continuation-in-part of application No. 09/192,857, filed on Nov. 16, 1998, now Pat. No. 5,944,642, which is a continuation-in-part of application No. 09/149,181, filed on Sep. 8, 1998, now Pat. No. 5,935,048.

(60) Provisional application No. 60/159,866, filed on Oct. 15, 1999, and provisional application No. 60/162,291, filed on Oct. 28, 1999.

(51) Int. Cl.[7] ..... A03B 21/06

(52) U.S. Cl. ..... 482/98; 482/99

(58) Field of Search ..... 482/93, 94, 97–103, 482/133, 136–138, 148, 908

(56) References Cited

U.S. PATENT DOCUMENTS

| | | | | |
|---|---|---|---|---|
| 4,627,615 A | | 12/1986 | Nurkowski | 482/98 |
| 4,765,611 A | | 8/1988 | MacMillan | 482/98 |
| 4,809,973 A | | 3/1989 | Johns | 482/98 |
| 4,834,365 A | | 5/1989 | Jones | 482/99 |
| 5,344,375 A | * | 9/1994 | Cooper | 482/104 |
| 5,643,152 A | | 7/1997 | Simonson | 482/98 |
| 5,776,040 A | | 7/1998 | Webb et al. | 482/98 |

FOREIGN PATENT DOCUMENTS

| | | | |
|---|---|---|---|
| FR | 2613237 | 10/1980 | 482/99 |
| JP | 10-118222 | 5/1998 | 482/98 |
| SU | 1347948 | 10/1987 | 482/98 |
| SU | 1443898 | 12/1988 | 482/98 |

OTHER PUBLICATIONS

Cybex Strength Systems (Brochure) © 1994 (6 pages).

* cited by examiner

*Primary Examiner*—John Mulcahy

(57) ABSTRACT

At least one supplemental weight is selectively movable into and out of the path traversed by the top plate in a weight stack. The supplemental weight(s) may be configured to register with the top plate, provided with handle(s), and/or added to existing weight stack equipment.

23 Claims, 31 Drawing Sheets

Fig. 26
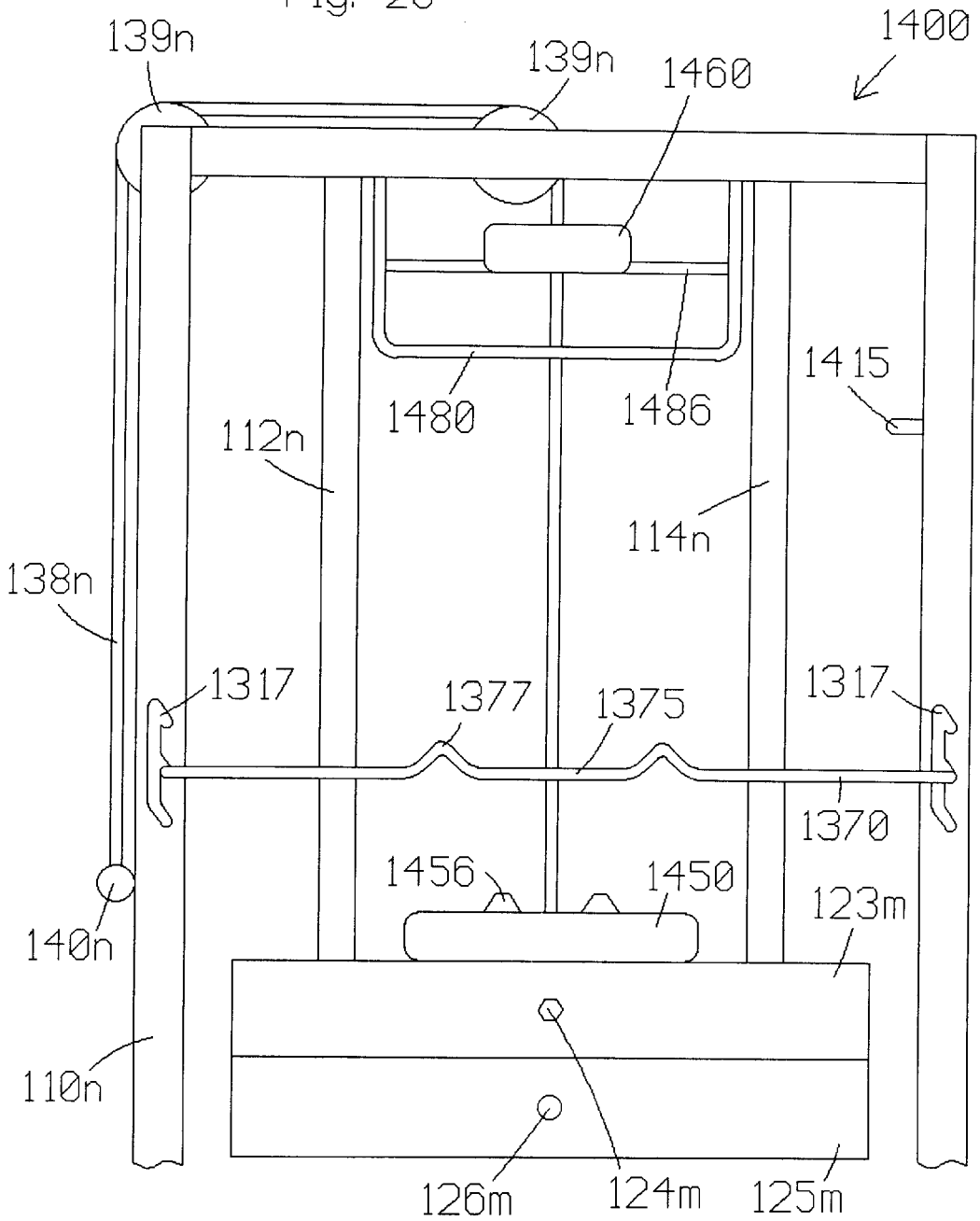
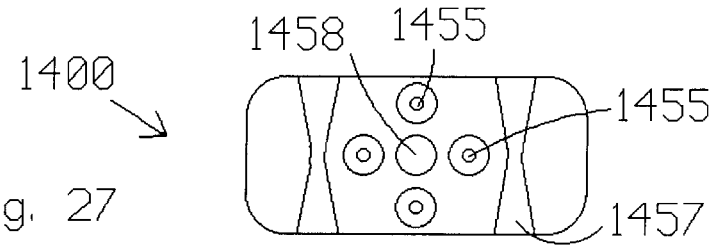
Fig. 27

Fig. 29
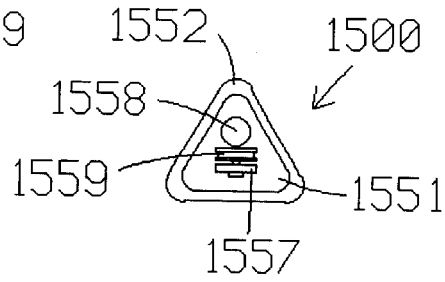
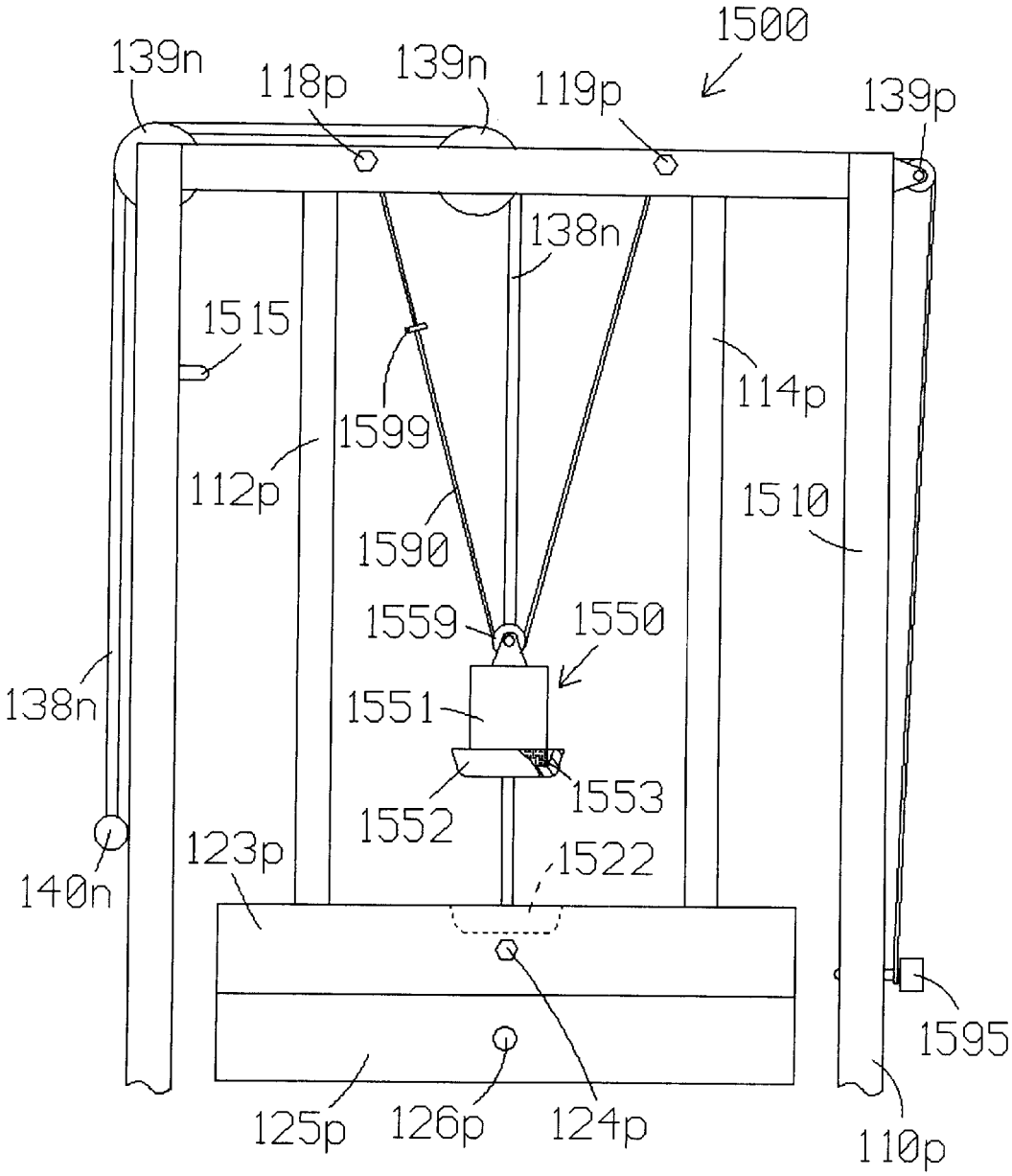
Fig. 28

Fig. 40
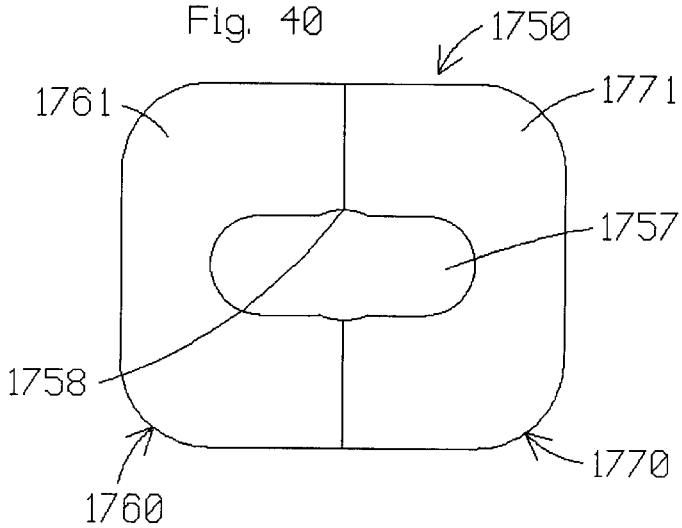
Fig. 43
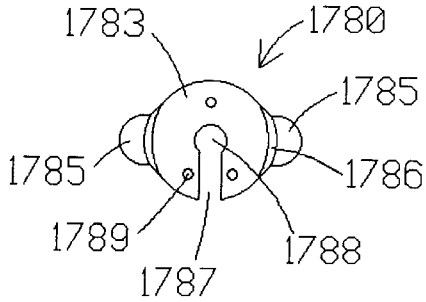
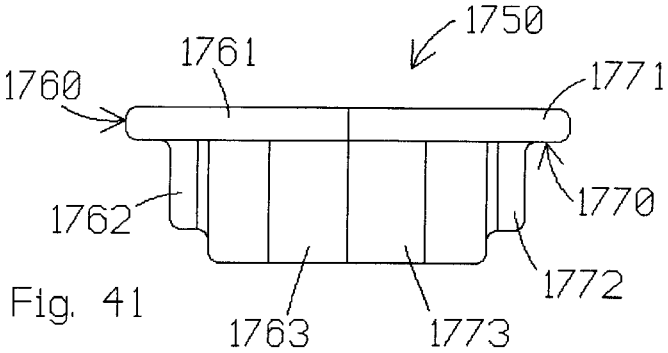
Fig. 41
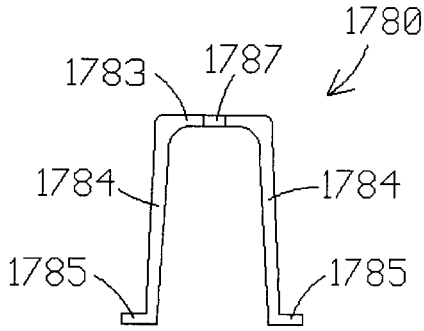
Fig. 44
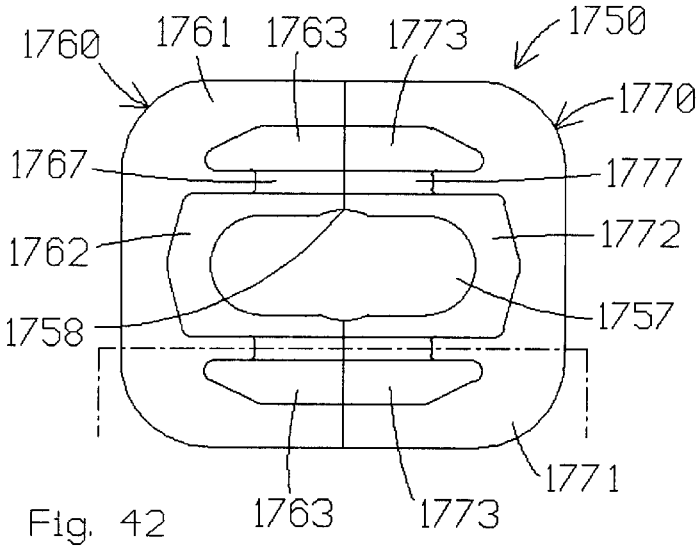
Fig. 42
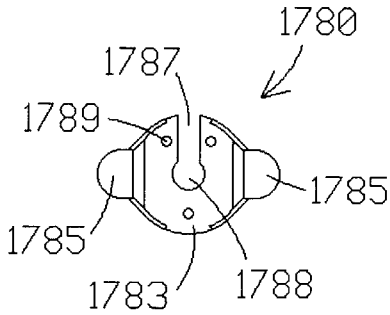
Fig. 45

Fig. 46
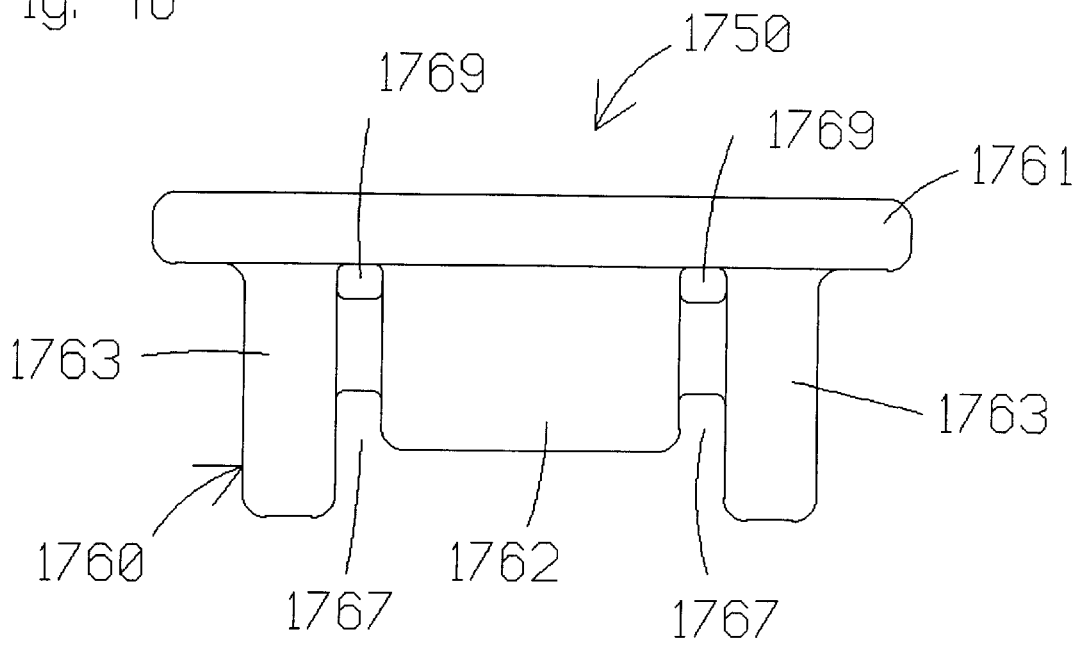
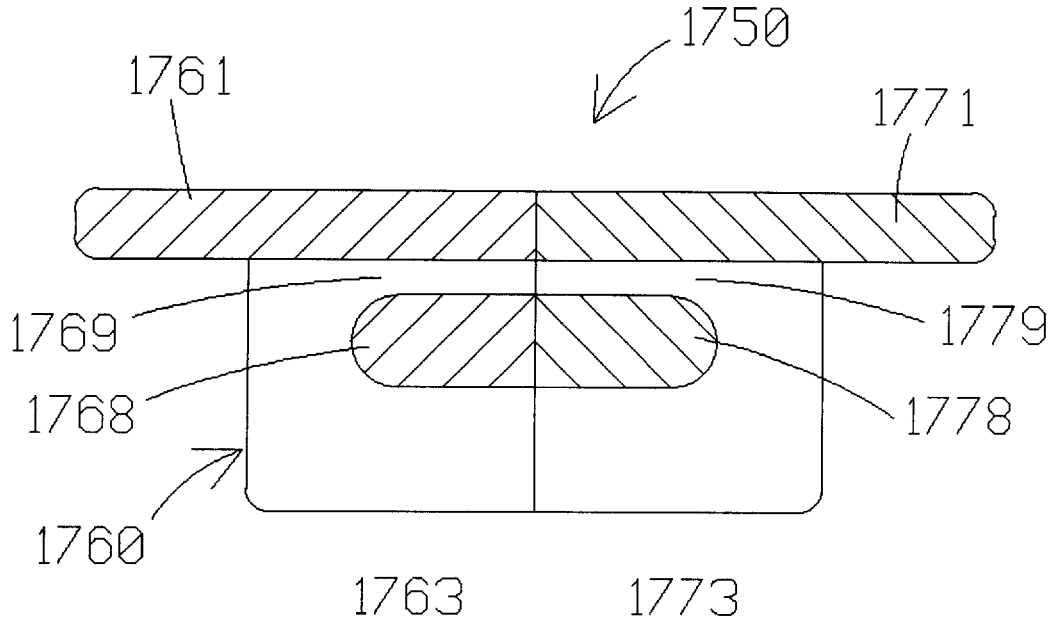
Fig. 47

METHODS AND APPARATUS FOR ADJUSTING RESISTANCE TO EXERCISE

CROSS-REFERENCE TO RELATED APPLICATION

This application is a continuation-in-part of U.S. patent application Ser. No. 09/387,160, filed on Aug. 31, 1999, and sebsequently issued as U.S. Pat. No. 6,183,401, which in turn, is a continuation-in-part of U.S. patent application Ser. No. 09/192,857, filed on Nov. 16, 1998, and subsequently issued as U.S. Pat. No. 5,944,642, which in turn, is a continuation-in-part of U.S. patent application Ser. No. 09/149,181, filed on Sep. 8, 1998, and subsequently issued as U.S. Pat. No. 5,935,048, and claims benefit of Provisional Application Nos. 60/159,866 and 60/162,291 filed Oct. 15, 1999 and Oct. 28, 1999 respectively.

FIELD OF THE INVENTION

The present invention relates to exercise equipment and more particularly, to exercise equipment that uses a variable number of weights to resist exercise motion.

BACKGROUND OF THE INVENTION

Exercise weight stacks are known in the art. Generally speaking, weights are arranged in a stack and movably mounted on at least one guide rod or rail. A selector rod is connected to a desired number of weights by a pin (or other suitable means known in the art). The selector rod and any selected weights are connected to a force receiving member by a cable (or other suitable means known in the art) which moves the weights upward in response to exercise movement.

Although exercise weight stacks are prevalent in the exercise industry, they nonetheless suffer from certain shortcomings. For example, in order to provide a large amount of weight at a reasonable cost and within a reasonable amount of space, equipment manufacturers use a small number of relatively heavy weights. As a result, the amount of weight being lifted cannot be adjusted in small increments. On the other hand, a relatively large number of lighter weights could be used in order to provide smaller increments in weight adjustment, but the resulting equipment would be relatively more expensive and/or bulky.

Attempts have been made to address the issue of incremental adjustments. One such approach involves the provision of a loose half-weight which is available for movement onto the top plate at the discretion of a user. This particular arrangement is not well suited for institutional environments because the half-weight may be lost or misused. Another prior art approach involves the provision of a half-weight (or other fractional weights), which weighs one-half the weight of each weight in the stack, and which is selectively movable from a peg on the frame onto an aligned peg on the top plate of the stack. This approach not only fails to overcome the possibility of losing the half-weight, but it also creates a balance problem during movement of the selected weights, and increases the potential for injury due to the proximity of the two pegs and their movement relative to one another. Yet another prior art approach involves the provision of a second, adjacent weight stack comprising weights which weigh a fraction of the weights in the primary weight stack. Unfortunately, this approach adds significantly to both the cost and the size of the equipment.

Yet another prior art machine with supplemental weights is disclosed in French Patent No. 2,613,237 to Louvet. The Louvet machine includes a stack of primary weights movable along a guide rod in response to exercise movement, and a stack of secondary weights movable along the guide rod and selectively stored above the stack of primary weights. The secondary weights are supported by gates which are rotatably mounted on rigid frame members and which have pegs that rotate into engagement with holes in the frame members. Each of nine secondary weights has a mass equal to one-tenth the mass of one of the primary weights. One disadvantage of the Louvet machine is that nothing prevents a user from releasing a secondary weight without grasping the weight being released. As a result, the secondary weight may be free to drop downward onto the top plate in the stack of primary weights, thereby increasing the likelihood of personal injury and/or damage to the machine. Also, each of the secondary weights is not separately supported by a respective gate. As a result, the entire stack of secondary weights may be released at one time, with or without a user holding onto to any of the secondary weights. Yet another shortcoming of the Louvet machine is that nine secondary weights are required to provide nine levels of incremental weight adjustments.

Still other prior art approaches are disclosed in Soviet Union Patent No. 1347-948-A and Japan Patent No. 10-118222. Each of these patents discloses first and second supplemental weights which are movably mounted on discrete guide rods outside the planform of the primary weight stack. The supplemental weights in the Soviet patent are pivotally mounted on respective guide rods for optional movement into the path of the primary weight stack, whereas the supplemental weights in the Japan patent are releasably secured to the top plate by a separate selector pin. A shortcoming common to both of these approaches are inadequate is the need for separate guide rods to accommodate the supplemental weights. In other words, despite all of the efforts discussed above, room for better solutions and/or improvements remains.

SUMMARY OF THE INVENTION

The present invention generally involves the provision of at least one supplemental weight for use on an exercise apparatus having a stack of weight plates movably mounted on a frame. The supplemental weight is selectively movable into and out of the path traversed by the top plate in the stack. In a first mode of operation, the supplemental weight is supported by a frame member in an inactive position, outside the path of the top plate, thereby allowing the top plate to move relative to the supplemental weight and the frame. In a second mode of operation, the supplemental weight occupies an active position, within the path of the top plate, thereby adding resistance to movement of the top plate relative to the frame.

One aspect of the present invention is to connect a handle to the supplemental weight to facilitate maneuvering of the supplemental weight between the inactive position and the active position. On some embodiments of the present invention, the handle is rigidly connected to the supplemental weight, while on other embodiments, a flexible connector is interconnected between the supplemental weight and the handle, and is routed about at least one guide on the frame. In either case, the handle and the supplemental weight may be disposed on opposite sides of a shield on the exercise apparatus, and the shield may be used to support the supplemental weight in the inactive position.

Another aspect of the present invention is to provide the supplemental weight and the top plate with complementary structures which register the supplemental weight relative to the top plate. For example, a boss on the supplemental weight may interengage a recess in the top plate when the former is disposed on top of the latter. Such structures maintain the supplemental weight in a desired position relative to the top plate, as well as the guide rods and connector associated with the top plate.

Yet another aspect of the present invention is to provide the supplemental weight in a form suitable for installation on existing equipment. For example, the supplemental weight may include complementary portions which can be secured about an intermediate portion of an elongate member, such as a weight stack guide rod or a connector extending between the top plate and a force receiving member. Also, a suitable holder may be secured to the frame to support the supplemental weight in the inactive position.

Still another aspect of the present invention is to provide supplemental weight(s) for movement along at least one weight stack guide rod and/or a connector interconnected between the top plate and a force receiving member, and to require the user to support the supplemental weight(s) during movement from an inactive position, supported by the frame above the path of the top plate, and an active position, inside the path of the top plate. This arrangement may be considered advantageous to the extent that a separate guide is not required for the supplemental weight(s), and/or the user must support the supplemental weight(s) during movement from the inactive position to the active position. With respect to supplemental weight(s) movable along the connector, such an arrangement may be considered advantageous to the extent that a low friction interface is not required between the supplemental weight(s) and the connector, and/or the supplemental weight(s) may be accessible through a longitudinally extending slot that is aligned with the selector rod. With respect to supplemental weight(s) movable along at least one weight stack guide rod, such an arrangement may be considered advantageous to the extent that the supplemental weight is constrained to travel along a more definite path, and/or the supplemental weight(s) may be fitted with the same bushings as the weight plates in the stack.

Yet another aspect of the present invention is to provide multiple supplemental weights with discrete amounts of mass, and allow the user to choose between the mass of the first weight, the mass of the second weight, and the combined mass of the two weights. For example, a half-weight and a quarter-weight may be movably mounted on respective weight stack guide rods and activated and deactivated in any order and/or combination.

The foregoing aspects of the present invention may be implemented individually and/or in various combinations. The present invention may also be implemented with different active positions for the supplemental weight, including on top of the top plate and/or supported at an intermediate point along the path of the top plate. In other words, the present invention can be used to facilitate conventional weight stack resistance together with fractionally increased weight stack resistance which remains constant throughout a range of motion and/or which varies during an exercise stroke.

On several embodiments of the present invention, the supplemental weight and the top plate cooperate to maintain a relatively large ring of space between the supplemental weight and any member extending through and/or adjacent the supplemental weight, in order to discourage contact therebetween during operation of the weight stack. In the alternative, and on certain other embodiments, the supplemental weights are movably mounted on the frame member (s) by bushings (or other suitable arrangements known in the art). Furthermore, the supplemental weights may be movably connected to dedicated flexible guides in the alternative.

The present invention may also be described in terms of various methods for positioning and/or selecting the supplemental weight(s). Many features, advantages, and/or variations of the present invention will become apparent from the more detailed description that follows.

BRIEF DESCRIPTION OF THE FIGURES OF THE DRAWING

With reference to the Figures of the Drawing, wherein like numerals represent like parts and assemblies throughout the several views.

FIG. 26 is a partially fragmented, front view of a fourteenth exercise apparatus constructed according to the principles of the present invention;

FIG. 27 is a bottom view of a supplemental weight on the exercise apparatus of FIG. 26;

FIG. 28 is a partially fragmented, front view of a fifteenth exercise apparatus constructed according to the principles of the present invention;

FIG. 29 is a top view of a supplemental weight on the exercise apparatus of FIG. 28;

FIG. 40 is a top view of a supplemental weight on the exercise apparatus of FIG. 39;

FIG. 41 is a side view of the supplemental weight of FIG. 40;

FIG. 42 is a bottom view of the supplemental weight of FIG. 40;

FIG. 43 is a top view of a supplemental weight holder on the exercise apparatus of FIG. 39;

FIG. 44 is a side view of the supplemental weight holder of FIG. 43;

FIG. 45 is a bottom view of the supplemental weight holder of FIG. 43;

FIG. 46 is an end view of the supplemental weight of FIG. 40; and

FIG. 47 is a sectioned side view of the supplemental weight of FIG. 40.

DETAILED DESCRIPTION OF A PREFERRED EMBODIMENT

The present invention provides methods and apparatus related to incremental adjustment of weight stack resistance. More specifically, otherwise conventional weight stack machines are provided with at least one supplemental weight which weighs a fraction of the weights in the primary weight stack, and which is selectively movable onto or into the path of a top plate in the stack. The supplemental weight(s) may be provided in various numbers and with various masses. The patents identified above in the Background of the Invention are incorporated herein by reference to provide general information regarding weight stack exercise machines and their construction and operation.

Figure 1:
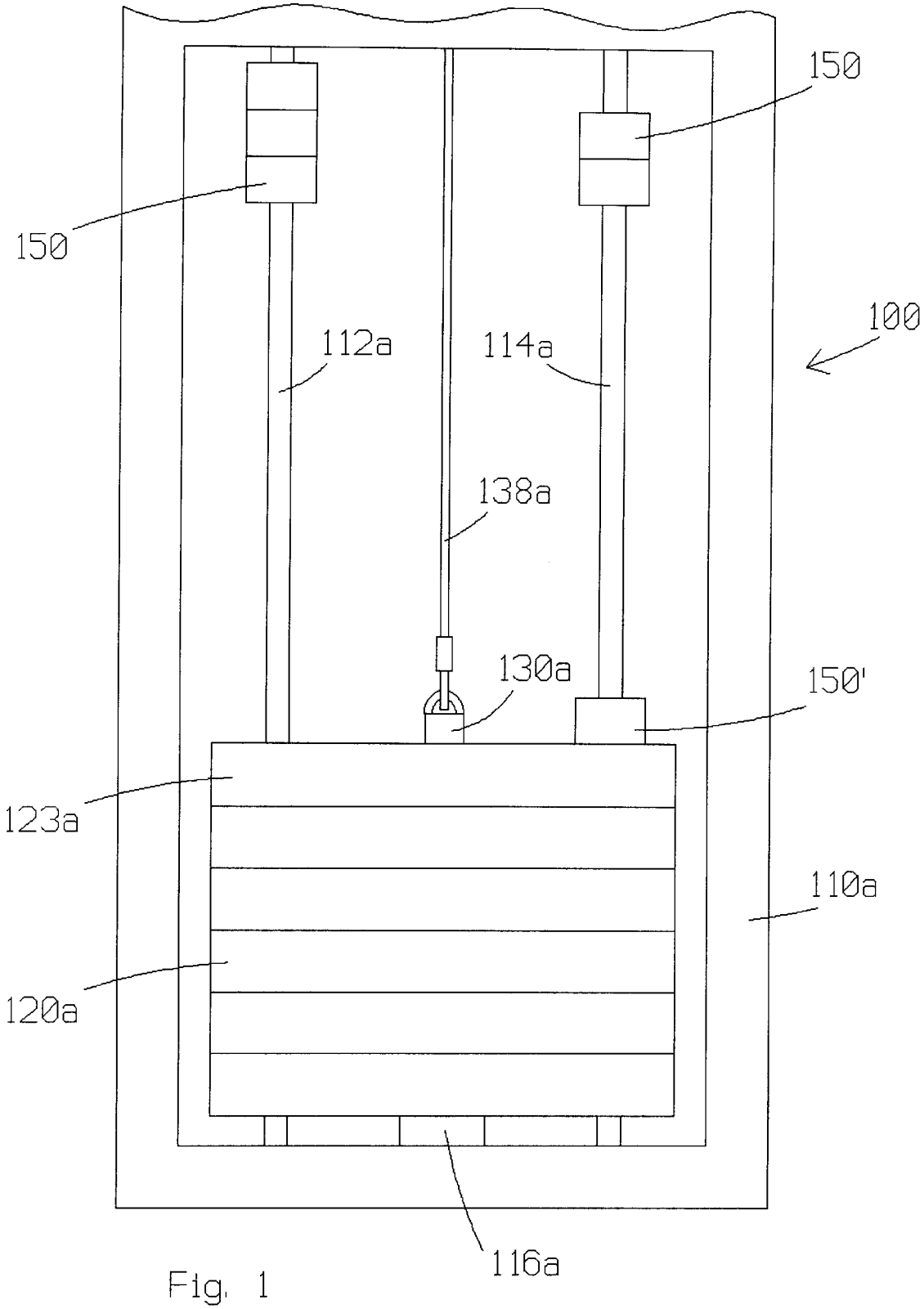
FIG. 1 is a partially fragmented, front view of a first exercise apparatus constructed according to the principles of the present invention.

FIG. 1 shows a weight stack machine 100 which has been assembled in accordance with the principles of the present invention. The machine 100 includes a frame 110*a* designed to rest upon a floor surface. First and second guide rods 112*a* and 114*a* extend vertically between lower and upper ends of the frame 110*a*. A top plate 123*a* and underlying weight plates 120*a* are movably mounted on the guide rods 112*a* and 114*a*. When not in use, the plates 123*a* and 120*a* rest against a shock absorbing member 116*a* on the lower end of the frame 110*a*.

A selector rod 130*a* extends through the plates 123*a* and 120*a* and is selectively connected to any desired plate 120*a* by a selector pin (or other suitable means known in the art). A cable 138*a* extends from an upper end of the selector rod 130*a* to one or more force receiving members which operate in a manner known in the art. As a result, movement of the force receiving member(s) is resisted by gravity acting on the selected number of plates.

Figure 2:
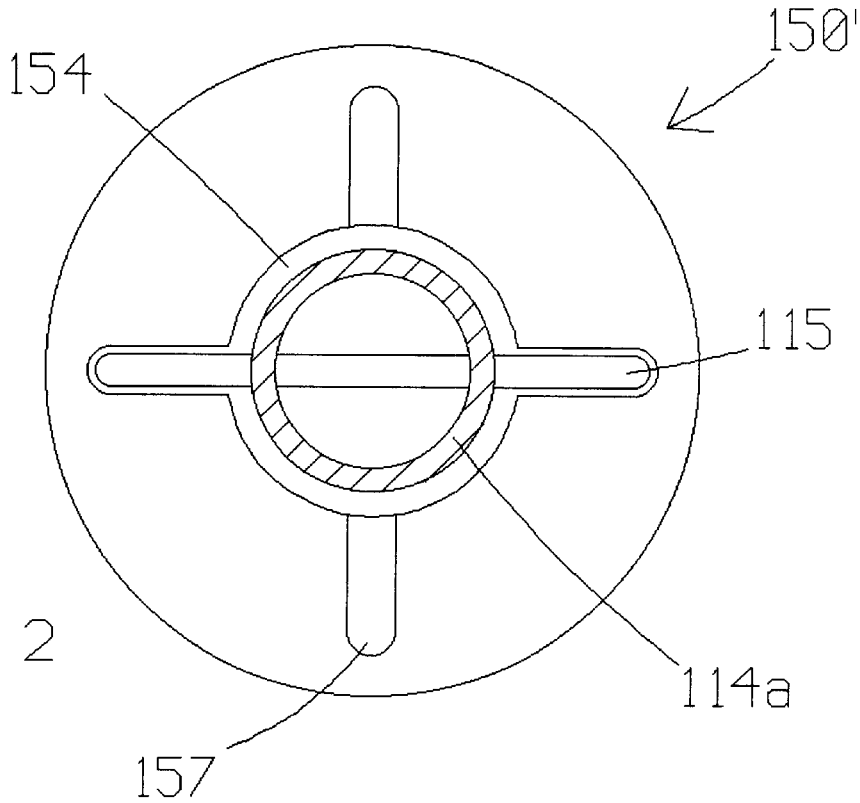
FIG. 2 is a partially sectioned, bottom view of a guide rod and supplemental weight on the exercise apparatus of FIG. 1.
Figure 3:
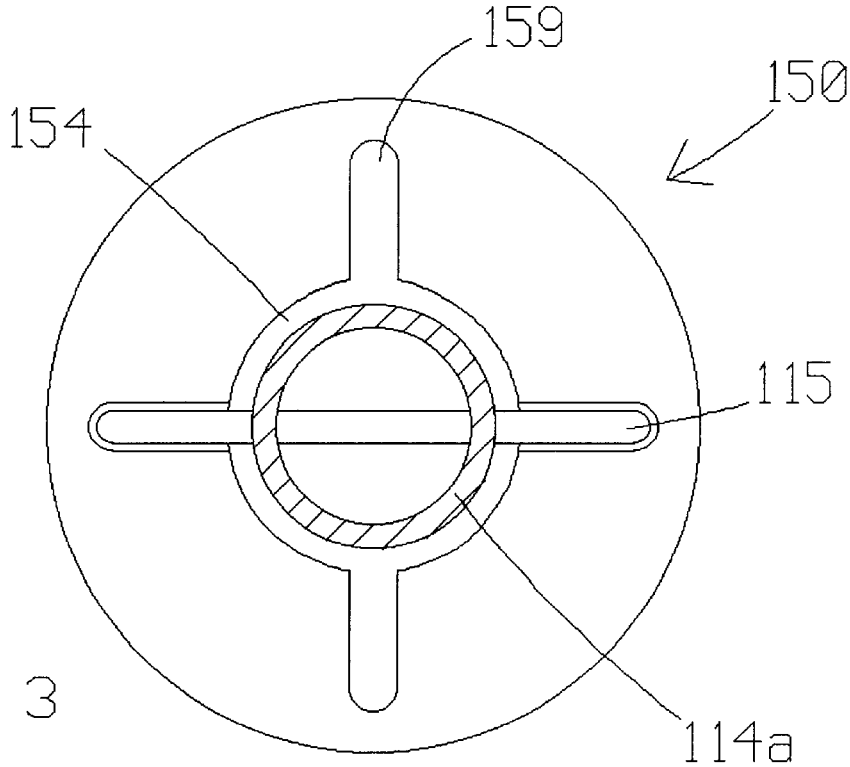
FIG. 3 is a partially sectioned, bottom view of the guide rod and supplemental weight of FIG. 2, the latter having been rotated ninety degrees relative to the former.

In accordance with the present invention, supplemental weights 150 and 150' are movably mounted on the guide rods 112*a* and 114*a* above the top plate 123*a*. As shown in FIGS. 2–3 (where the depicted guide rod 114*a* is representative of the other guide rod 112*a*), a pin 115 is rigidly secured to the guide rod 114*a* and extends perpendicular relative thereto.

A hole 154 is formed through each of the weights 150 and 150' to accommodate a respective one of the guide rods 112*a* or 114*a*. A transverse notch 157 is formed in the bottom of each weight 150 or 150' to engage the pin 115 when the weight 150 or 150' is oriented as shown in FIG. 3. A transverse slot 159, which extends perpendicular to the notch 157, is formed through each weight 150 or 150' to provide clearance for the pin 115 when the weight 150 or 150' is oriented as shown in FIG. 2. The weight designated as 150' in FIG. 1 was rotated ninety degrees relative to the weights 150 in order to descend the guide rod 114*a*. The top of each weight 150 or 150' may be provided with a ridge sized and configured to nest within the notch 157 and/or the slot 159 in an overlying weight 150. Such a ridge would cooperate with the notch 157 or the slot 159 to encourage simultaneous rotation of both the lower weight and the upper weight. Similar ridges may be provided on the top plate 123*a* to register with the lowest weight 150 on each guide rod 112*a* and 114*a*.

Those skilled in the art will recognize that the depicted embodiment 100 is capable of providing the same number and magnitude of resistance increments as the machine disclosed in French Patent No. 2,613,237, but with one-third fewer supplemental weights. In particular, if the three weights on the left-hand guide rod 112*a* include a one-half kilogram weight disposed between two one kilogram weights, and the three weights on the right-hand guide rod 114*a* includes a one kilogram weight disposed between two one-half kilogram weights, then various combinations of the six supplemental weights are available to provide weight adjustments between one-half kilogram and four and one-half kilograms, in increments of one-half kilogram (just like the nine supplemental weights on the Louvet machine).

Figure 30:
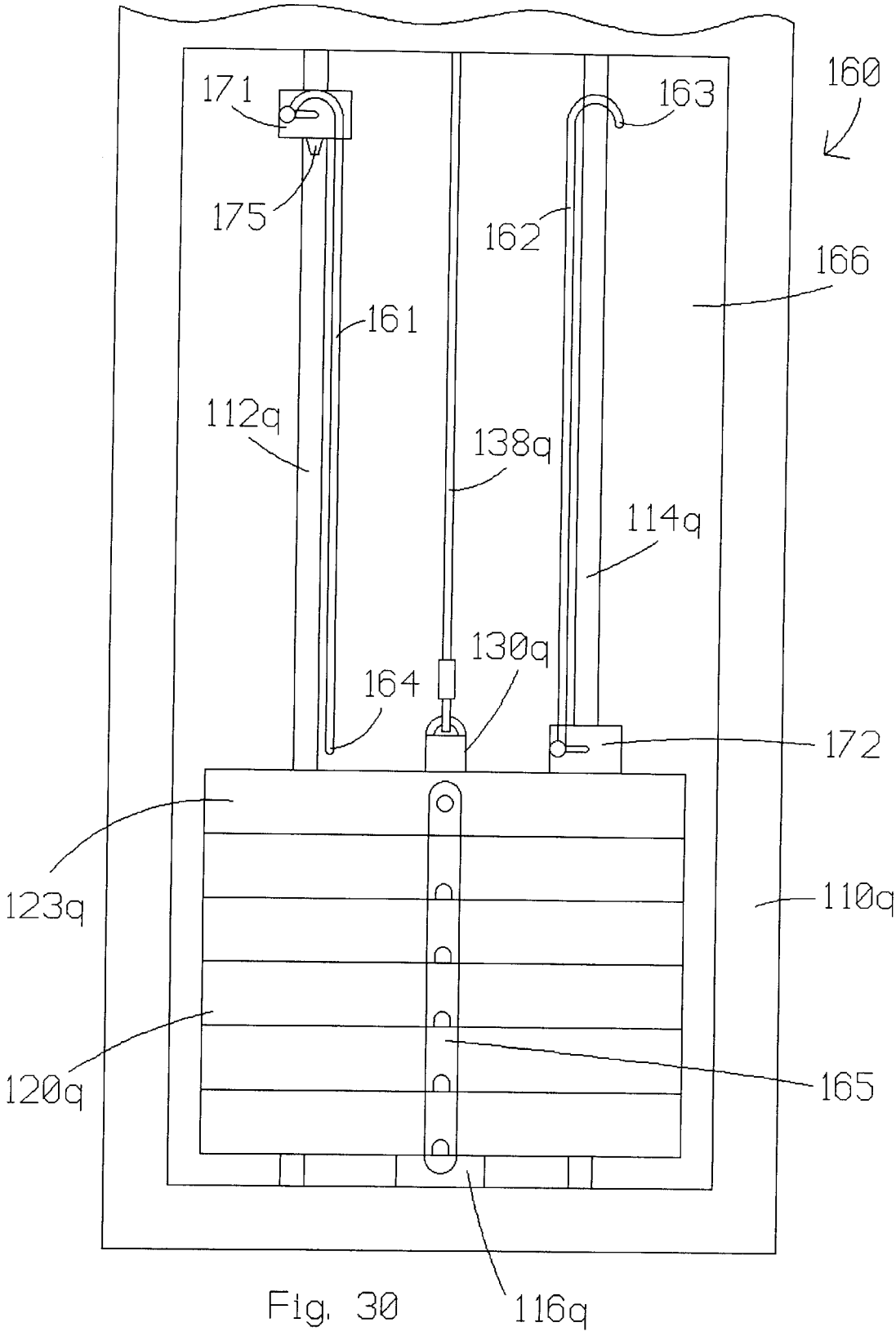
FIG. 30 is a partially fragmented, front view of a sixteenth exercise apparatus constructed according to the principles of the present invention.

FIG. 30 shows another weight stack machine 160 which has been assembled in accordance with the principles of the present invention. The machine 160 includes a frame 110*q* designed to rest upon a floor surface. First and second guide rods 112*q* and 114*q* extend vertically between lower and upper ends of the frame 110*q*. A top plate 123*q* and underlying weight plates 120*q* are movably mounted on the guide rods 112*q* and 114*q*. When not in use, the plates 123*q* and 120*q* rest against a shock absorbing member 116*q* on the lower end of the frame 110*q*.

A selector rod 130*q* extends through the plates 123*q* and 120*q*, is secured to the top plate 123*q*, and may selectively connected to any desired plate 120*q* by a selector pin (or other suitable means known in the art). A cable 138*q* (or other suitable means known in the art) extends from an upper end of the selector rod 130*q* to one or more force receiving members which operate in a manner known in the art. As a result, movement of the force receiving member(s) is resisted by gravity acting on the selected number of plates.

A transparent shield 166 spans the front of the machine 160 and effectively separates a user of the machine 160 from the guide rods 112*q* and 114*q* and the weight plates 123*q* and 120*q*. A central slot 165 is provided in the shield 166 to facilitate insertion of the selector pin into engagement with any desired weight plate 120*q*. This particular embodiment 160 requires a selector pin which inserts entirely inward of the shield 166, since the slot 165 does not extend upward above the lowermost position of the top plate 123*q*. Left and right slots 161 and 162 are provided in the shield 166 for reasons explained below. Those skilled in the art will recognize that the shield 166 may be reinforced in various ways (forward of the weight stack, for example) to enhance the structural integrity of the shield 164.

Figure 31:
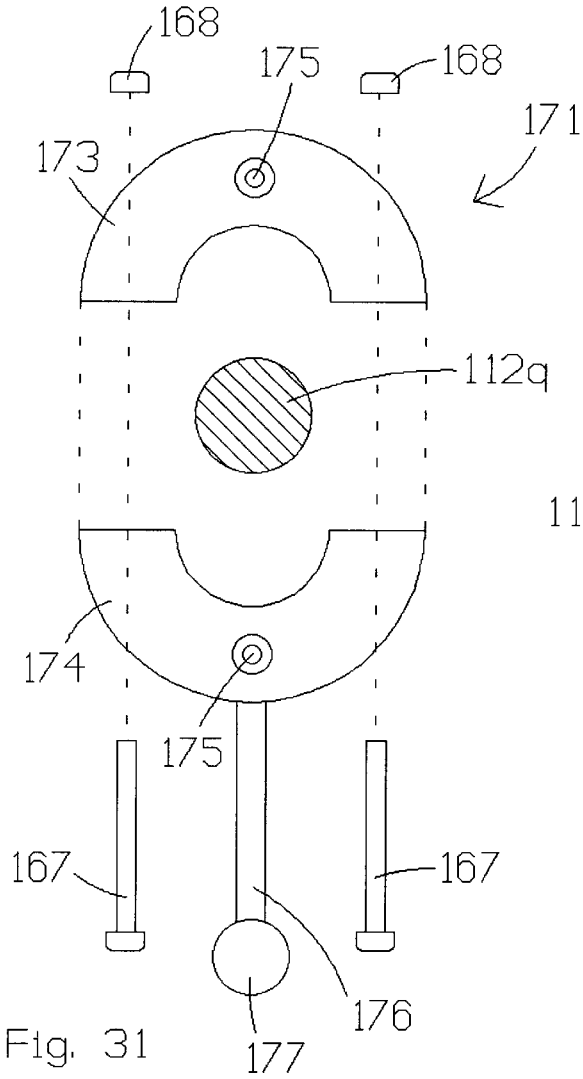
FIG. 31 is an exploded top view of a supplemental weight and associated guide rod on the exercise apparatus of FIG. 30
Figure 32:
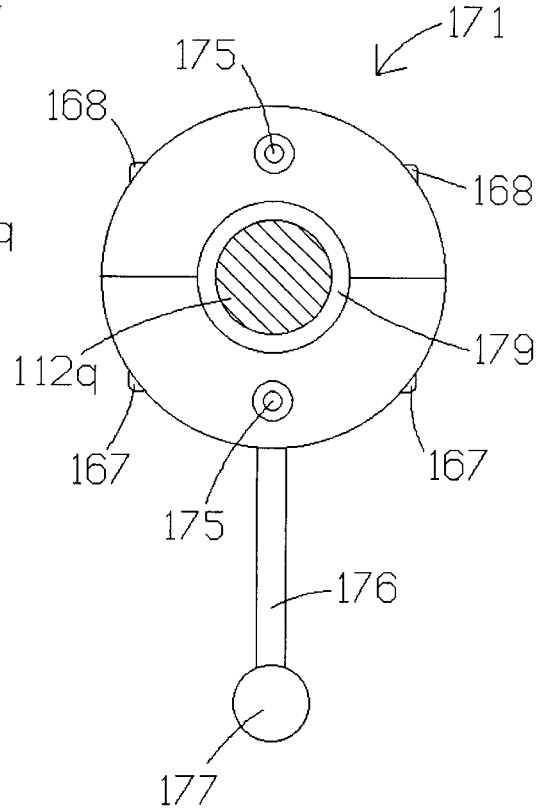
FIG. 32 is a bottom view of the supplemental weight of FIG. 31 assembled and mounted on the guide rod of FIG. 30.

Supplemental weights 171 and 172 are movable along respective guide rods 112*q* and 114*q* above the top plate 123*q*. Recognizing that the weights 171 and 172 may have different densities, the weights 171 and 172 are otherwise similar in construction and operation. The weight 171 is shown in greater detail in FIGS. 31–33. Although the weight may alternatively be formed as a single, unitary piece, the weight 171 is made from complementary first and second pieces 173 and 174 to facilitate retrofit mounting of the weight 171 on an intermediate portion of the guide rod 112*q* (without accessing either end thereof). With the exception of a handle (discussed below), the two pieces 173 and 174 are identical to one another.

Figure 33:
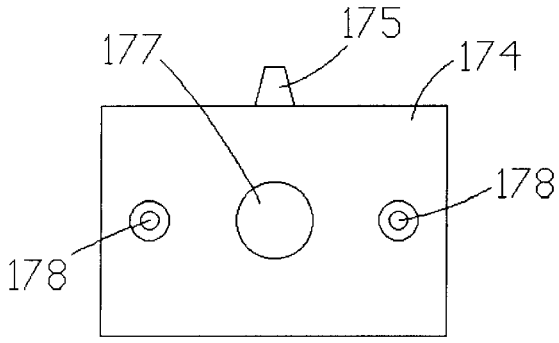
FIG. 33 is a front view of the supplemental weight of FIG. 32.

As shown in FIG. 33, with reference to the piece 174, transversely extending holes 178 are formed through each of the members to accommodate respective bolts 167 and nuts 168. The bolts 167 are inserted through the aligned holes 178 in the pieces 173 and 174 and are threaded into respective nuts 168. Those skilled in the art will recognize that other aligning and/or fastening methods may be used without departing from the scope of the present invention.

A central hole 179 is formed through the weight 171 to accommodate the guide rod 112*q*. The hole 179 is sufficiently large in diameter to establish an annular gap between the weight 171 and the guide rod 112*q*. For example, the hole 179 may have an inside diameter which is one-half inch greater than the outside diameter of the guide rod 112*q*. As a result of this discrepancy in sizes, the weight 171 may be moved up and down the guide rod 112*q* without contacting same. Toward this end, conical registration pegs 175 extend downward from the weights 171 and 172 and align with respective openings in the top plate 123*q* to maintain the weights 171 and 172 centered about and separate from respective guide rods 112*q* and 114*q*. The openings in the top plate 123*q* are configured to guide each of the weights 171 and 172 toward a particular, aligned position. Those skilled in the art will recognize that the weights 171 and 172 could alternatively be movably mounted on respective guide rods 112*q* and 114*q*, with bushings occupying the annular gaps, for example.

A shaft 176 extends radially outward from the member 174, and a knob 177 is secured to a distal end of the shaft 176. The shaft 176 is sized and configured to project through either of the slots 161 or 162 in the shield 166 (throughout a range of orientations), and the knob 177 is sized and configured for grasping. Each of the slots 161 and 162 may be described as an inverted J-shape having an upper distal end 163 and a lower distal end 164. When the shaft 176 occupies the upper distal end 163 of either slot 161 or 162, the respective weight 171 or 172 is supported by the shield 166 in an inactive, position outside the path of the top weight plate 123*q*. When the shaft 176 occupies the lower distal end 164 of either slot 161 or 162, the respective weight 171 or 172 occupies an active position, within the path of the top weight plate 123q. The upper, curved portions of the slots 161 and 162 discourage the respective weights 171 and 172 from unintentionally moving from the inactive position to the active position.

Those skilled in the art will recognize that the depicted embodiment 160 is capable of alternatively adding five pounds, ten pounds, and fifteen pounds to the weight of the top plate 123*q*, if the weight 171 is designed to weigh five pounds and the weight 172 is designed to weigh ten pounds, for example. Assuming that each of the weight plates 123*q* and 120*q* weighs twenty pounds, the resulting machine would provide resistance between twenty and one hundred and thirty-five pounds in five pound increments. Those skilled in the art will also recognize that different amounts and/or sizes of weight plates 120*q* may be used to provide different ranges and/or increments of resistance.

Figure 34:
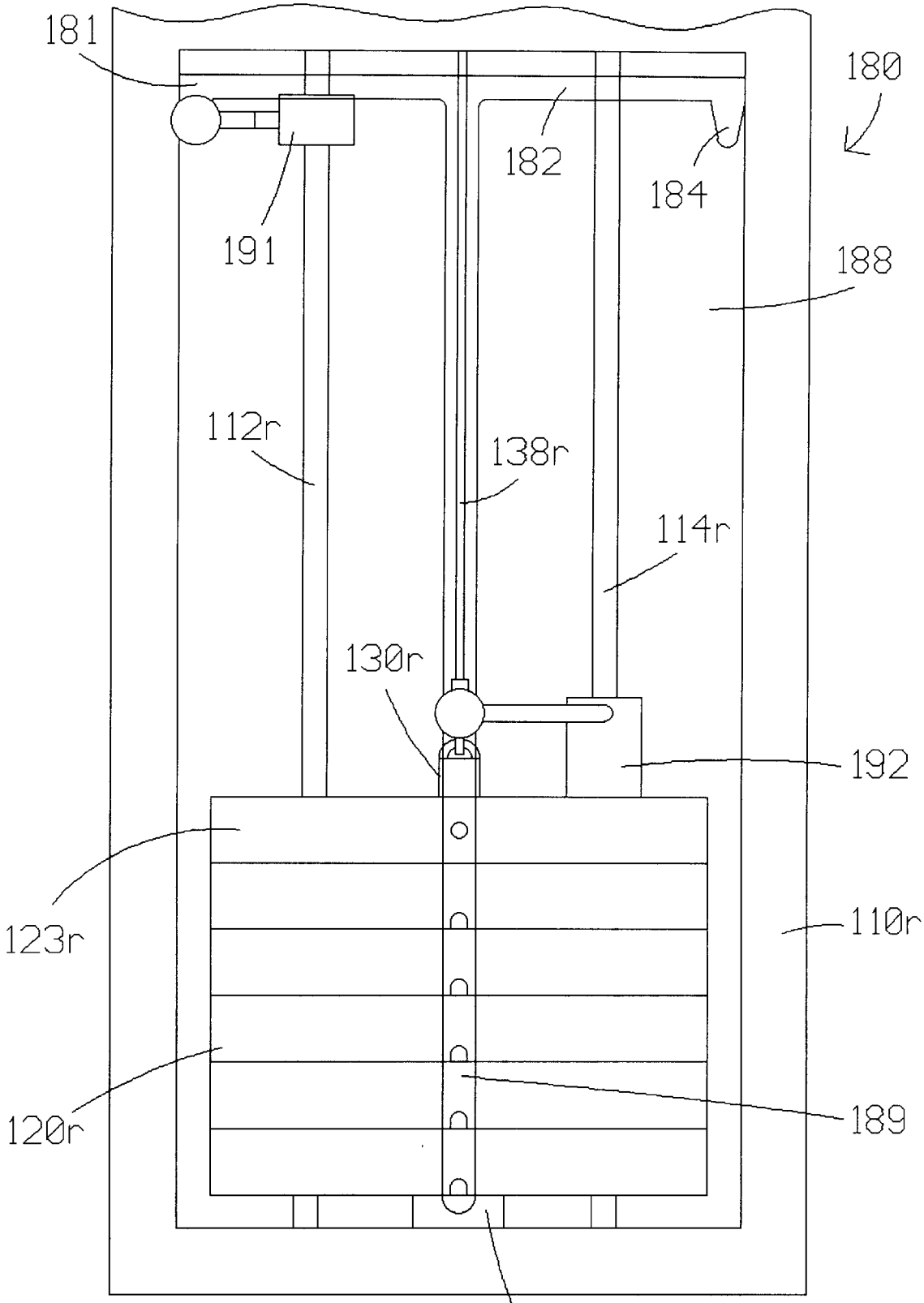
FIG. 34 is a partially fragmented, front view of a seventeenth exercise apparatus constructed according to the principles of the present invention.

FIG. 34 shows another weight stack machine 180 which has been assembled in accordance with the principles of the present invention, and which is similar in many respects to the foregoing embodiment 160. The machine 180 similarly includes a weight stack, including top plate 123*r* and underlying plates 120*r*, movably mounted on guide rods 112*r* and 114*r*. A selector rod 130*r* extends through the weight stack and is connected to a force receiving member by means of cable 138*r*.

A shield 188 spans the front of the machine 180 and effectively separates a user of the machine 180 from the guide rods 112*r* and 114*r* and the weight plates 123*r* and 120*r*. A T-shaped slot 189 is provided in the shield 188 to facilitate insertion of the selector pin into engagement with any desired weight plate 120*r*. This embodiment 180 may be used with a selector pin which projects outside the shield 188, since the slot 189 extends along the entire path of the weights 123*r* and 120*r*. The laterally extending portions 181 and 182 of the slot 189 are provided in the shield 188 to accommodate movement of respective supplemental weights 191 and 192, which are similar in certain respects to those discussed above with reference to the machine 160. Again, those skilled in the art will recognize that the shield 188 may be reinforced in various ways (forward of the weight stack, for example) to the extent enhance the structural integrity of the shield 188.

Figure 35:
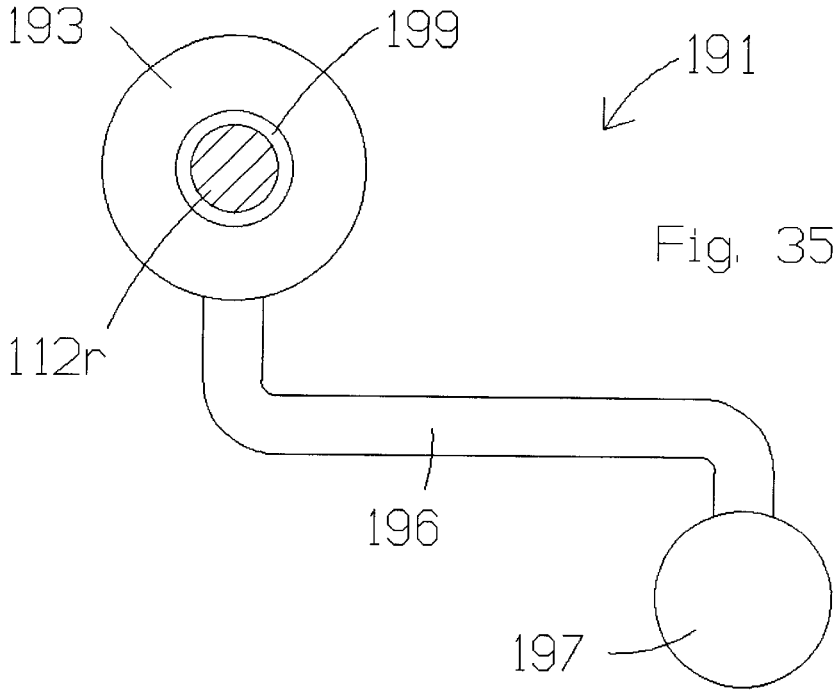
FIG. 35 is a top view of the supplemental weight and associated guide rod on the exercise apparatus of FIG. 34.

The supplemental weights 191 and 192 are movably mounted on respective guide rods 112*r* and 114*r* above the top plate 123*r*. The weight 192 is shown twice as large as the weight 191 to emphasize that it weighs twice as much, but in all other respects, the weights 191 and 192 are similar in construction and operation. The weight 191 is shown in greater detail in FIG. 35. Although the weight 191 is shown to be a unitary member 193, those skilled in the art will recognize that it could be provided in complementary pieces in much the same manner as the weight 171 described above.

A central hole 199 extends through the weight 191 to accommodate the guide rod 112*r*. Like on the previous embodiment 160, the hole 199 is sufficiently large in diameter to establish an annular gap between the weight 191 and the guide rod 112*r*, but it could be configured and/or fitted with a bushing to glide along the guide rod 112*r* in the alternative. The weights 191 and 192 may be registered relative to the top plate 123*r* by any suitable structure, including interengaging pegs and holes like those described with reference to the previous embodiment 160.

A twice bent shaft 196 extends radially outward from the weight 191, and a knob 197 is secured to an opposite, distal end of the shaft 196. The shaft 196 is sized and configured to project through the slot 189 in the shield 188 (throughout a range of orientations), and the knob 197 is sized and configured for grasping. Each of the transverse slots 181 and 182 terminates in a downwardly extending notch 184 which is sized and configured to retain a respective shaft 196 (with the relative longer, intermediate segment of the shaft 196 extending through the shield 188). FIG. 34 shows the weight 191 in this position, supported by the shield 188 outside the path of the top plate 123*r*. Either weight 191 or 192 may be rotated to an orientation wherein a respective shaft 196 is slidable along the central vertical portion of the slot 189 (with the shaft segment nearest the knob 197 extending through the shield 188). FIG. 34 shows the weight 192 in this position, supported by the top plate 123*r*. The two weights 191 and 192 are configured so that the shaft 196 on the former does not interfere with the shaft 196 on the latter when the weight 191 is moved onto the top plate 123*r* before the weight 192.

Figure 36:
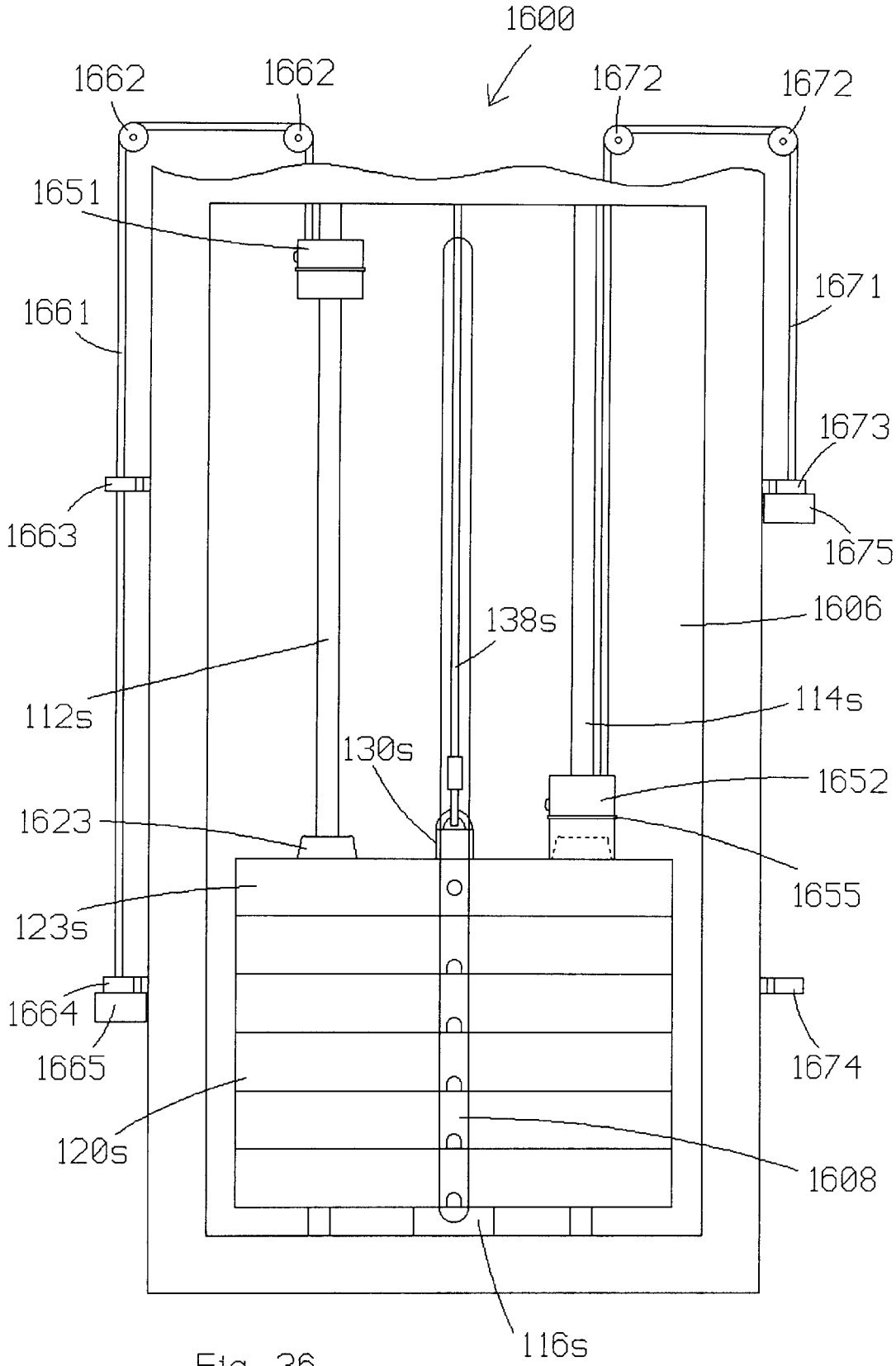
FIG. 36 is a partially fragmented, front view of an eighteenth exercise apparatus constructed according to the principles of the present invention.

FIG. 36 shows another weight stack machine 1600 which has been modified in accordance with the principles of the present invention, and which is similar in several respects to the foregoing embodiment 180. The machine 1600 similarly includes a weight stack, including top plate 123*s* and underlying plates 120*s*, movably mounted on guide rods 112*s* and 114*s*. A selector rod 130*s* extends through the weight stack and is connected to a force receiving member by means of cable 138*s*.

A shield 1606 spans the front of the machine 1600 and effectively separates a user of the machine 1600 from the guide rods 112*s* and 114*s* and the weight plates 123*s* and 120*s*. A central slot 1608 is provided in the shield 1606 to facilitate insertion of the selector pin into engagement with any desired weight plate 120*s*. This embodiment 1600 may be used with a selector pin which projects outside the shield 1606, since the slot 1608 extends along the entire path of the weights 123*s* and 120*s*.

Figure 37:
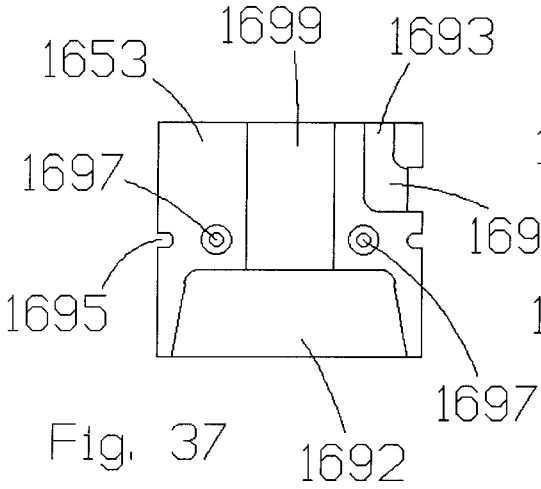
FIG. 37 is a front view of a first half of a supplemental weight on the exercise apparatus of FIG. 36.
Figure 38:
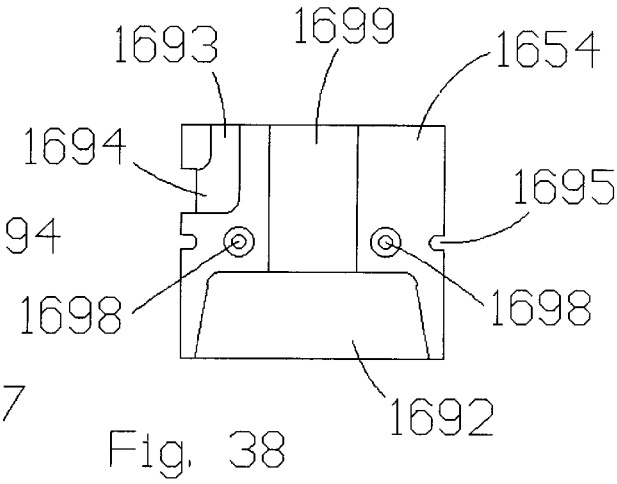
FIG. 38 is a rear view of a complementary second half of the same supplemental weight on the exercise apparatus of FIG. 36.

Supplemental weights 1651 and 1652 are movable along respective guide rods 112*s* and 114*s* above the top plate 123*s*. Again, the weight 1652 is shown twice as large as the weight 1651 to emphasize that it weighs twice as much, but in all other respects, the weights 1651 and 1652 are similar in construction and operation. Although the weights could alternatively be provided as unitary members, the depicted weights 1651 and 1652 include complementary pieces which may be secured about the intermediate portion of either guide rod 112*s* or 114*s* (without accessing either end). The complementary pieces 1653 and 1654 of the weight 1651 are shown in greater detail in FIGS. 37 and 38.

With the exception of registration pegs 1697 on the first piece 1653 and opposing, mating holes 1698 on the second piece 1654, the two pieces of the weight 1651 are mirror images of one another. The pegs 1697 and the holes 1698 interengage to maintain the two pieces 1653 and 1654 in alignment with one another. Each piece 1653 and 1654 has a central bore 1699 which is sized and configured to accommodate the guide rod 112*s* in the same manner as the weights 171 and 191. Each bore 1699 intersects a downwardly opening, central cavity 1692 which is sized and configured to register with a conical bushing 1623 on the top plate 123*s*. Each bushing 1623 glides along a respective guide rod 112*s* or 114*s* and maintains a respective weight 1651 or 1652 out of contact with same. For reasons explained below, an L-shaped opening is provided with a relatively narrower, upwardly opening passage 1693, and a relatively wider, transversely opening passage 1694. Also, an annular groove 1695 extends about the circumference of each piece 1653 and 1654 to accommodate and retain a flexible fastener 1655, which may a conventional, ribbed cable tie (or other suitable means known in the art). Resilient bumpers may be mounted on the bottoms of the weights 1651 and 1652 and/or the top of the top plate 123*s* (and/or on corresponding members on other embodiments, as well).

The supplemental weights 1651 and 1652 are selectively movable onto the top plate 123*s* along paths dictated by guide rods 112*s* and 114*s*. Each of the weights 1651 and 1652 is connected to a respective remote handle 1665 or 1675 by means of a respective cord 1661 or 1671. A first end of each cord 1661 and 1671 is connected to a respective handle 1665 or 1675, and an opposite, second end of each cord 1661 and 1671 is inserted through the passages 1693 and 1694 in a respective weight 1651 or 1652 and knotted or otherwise secured against passage back out the passage 1693. The transversely extending passage 1694 accommodates at least a portion of the knot or other fastener. The cord 1661 is routed about pulleys 1662 rotatably mounted on the frame 110*s*, and through brackets 1663 and 1664 rigidly mounted on the frame 110*s*. The cord 1671 is similarly routed about pulleys 1672 rotatably mounted on the frame 110*s*, and through brackets 1763 and 1764 rigidly mounted on the frame 110*s*.

The handle 1665 is positioned beneath the lower bracket 1664 to hold the weight 1651 in the depicted storage position, outside the path of the top plate 123*s*. On the other side, the handle 1675 is positioned beneath the upper bracket 1673, having allowed the weight 1652 to move downward onto the top plate 123*s*. An advantage of this embodiment is that the weights 1651 and 1652 may be lowered remotely and in any combination or order. Those skilled in the art will also recognize that such adjustments may be performed by a motor or actuator in the alternative.

Figure 4:
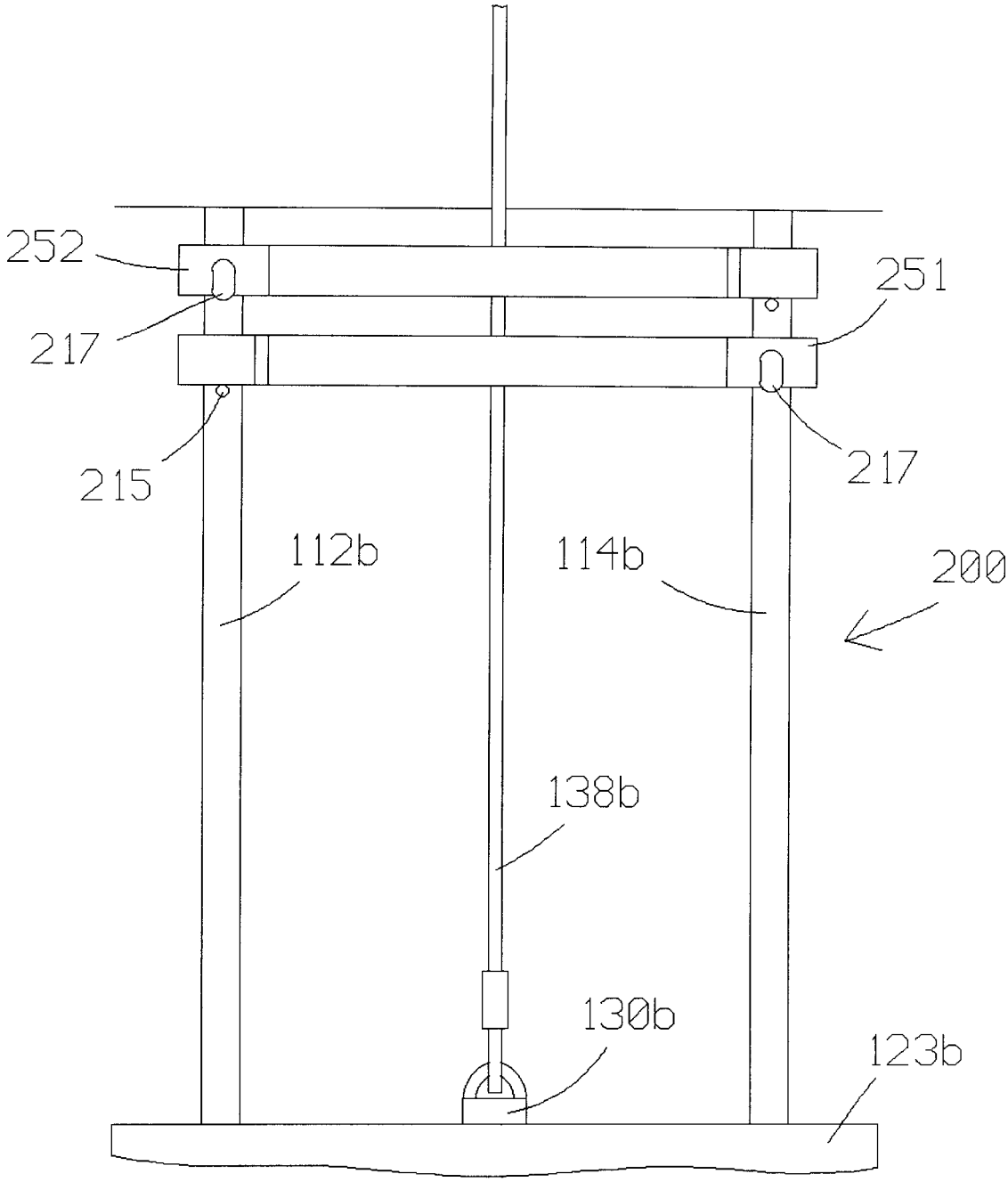
FIG. 4 is a partially fragmented, front view of a second exercise apparatus constructed according to the principles of the present invention.

FIG. 4 shows another weight stack machine 200 which has been assembled in accordance with the principles of the present invention. The machine 200 similarly includes a weight stack, including top plate 123*b*, movably mounted on guide rods 112*b* and 114*b*. A selector rod 130*b* extends through the weight stack and is connected to a force receiving member by means of cable 138*b*.

Figure 5:
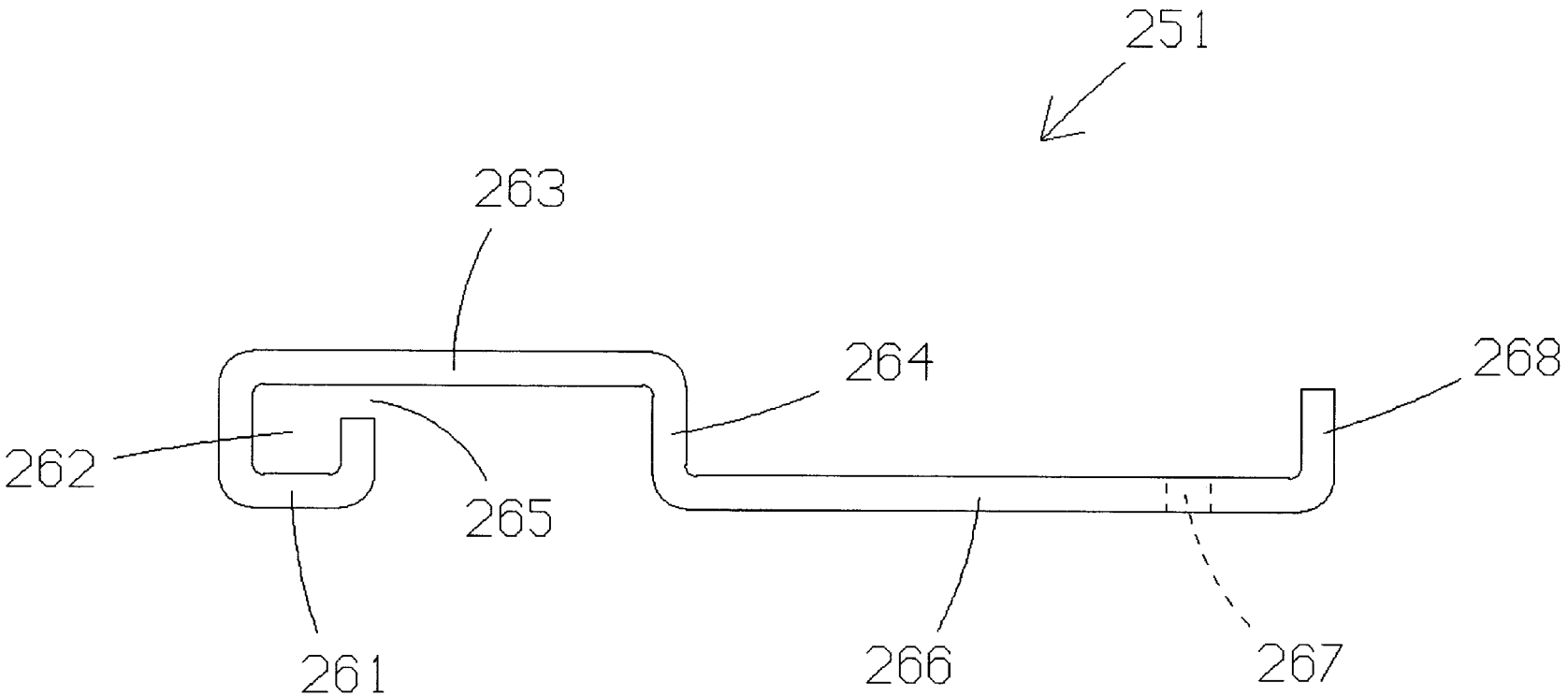
FIG. 5 is a top view of a supplemental weight on the exercise apparatus of FIG. 4.

Supplemental weights 251 and 252 are movable along the guide rods 112*b* and 114*b* above the top plate 123*b*. As shown in FIG. 5 (where the depicted weight 251 is a mirror image of the other weight 252), the weight 251 is a bar that has been bent or otherwise formed to interact with the guide rods 112*b* and 114*b* while avoiding the selector rod 130*b* and/or the cable 138*b*.

A first end 261 of the bar 251 forms a substantially closed loop which is interrupted by a slot 265 disposed between the end 261 and an intermediate segment 263. The loop bounds an opening 262 sufficient in size to accommodate the guide rod 112*b*. A central segment 264 of the bar 251 is interconnected transversely between the intermediate segment 263 and an opposite intermediate segment 266. The segments 263 and 266 are different lengths to space the segment 264 apart from the selector rod 130*b* and cable 138*b*. A notch 267 is formed in the underside of the segment 266, near the second, opposite end 268, for reasons explained below.

When the weight 251 is arranged as shown in FIG. 4, the first end 261 rests upon a transversely extending pin 215 rigidly secured to the guide rod 112*b*, and the segment 266 rests upon a transversely extending hook 217 rigidly secured to the guide rod 114*b*. The hook 217 has a transversely extending shaft which nests inside the notch 267, and an upwardly extending end which discourages rotation of the weight 251 about the guide rod 112*b*. The weight 251 is lowered onto the top plate 123*b* by lifting the weight 251 off the hook 217 and rotating the weight 251 until the slot 265 aligns with the pin 215. An advantage of this embodiment (and certain other embodiments described herein) is that the mass of each of the weights 251 and 252 is relatively evenly distributed across the top plate 123*b* and/or relative to the connector 138*b*.

Figure 6:
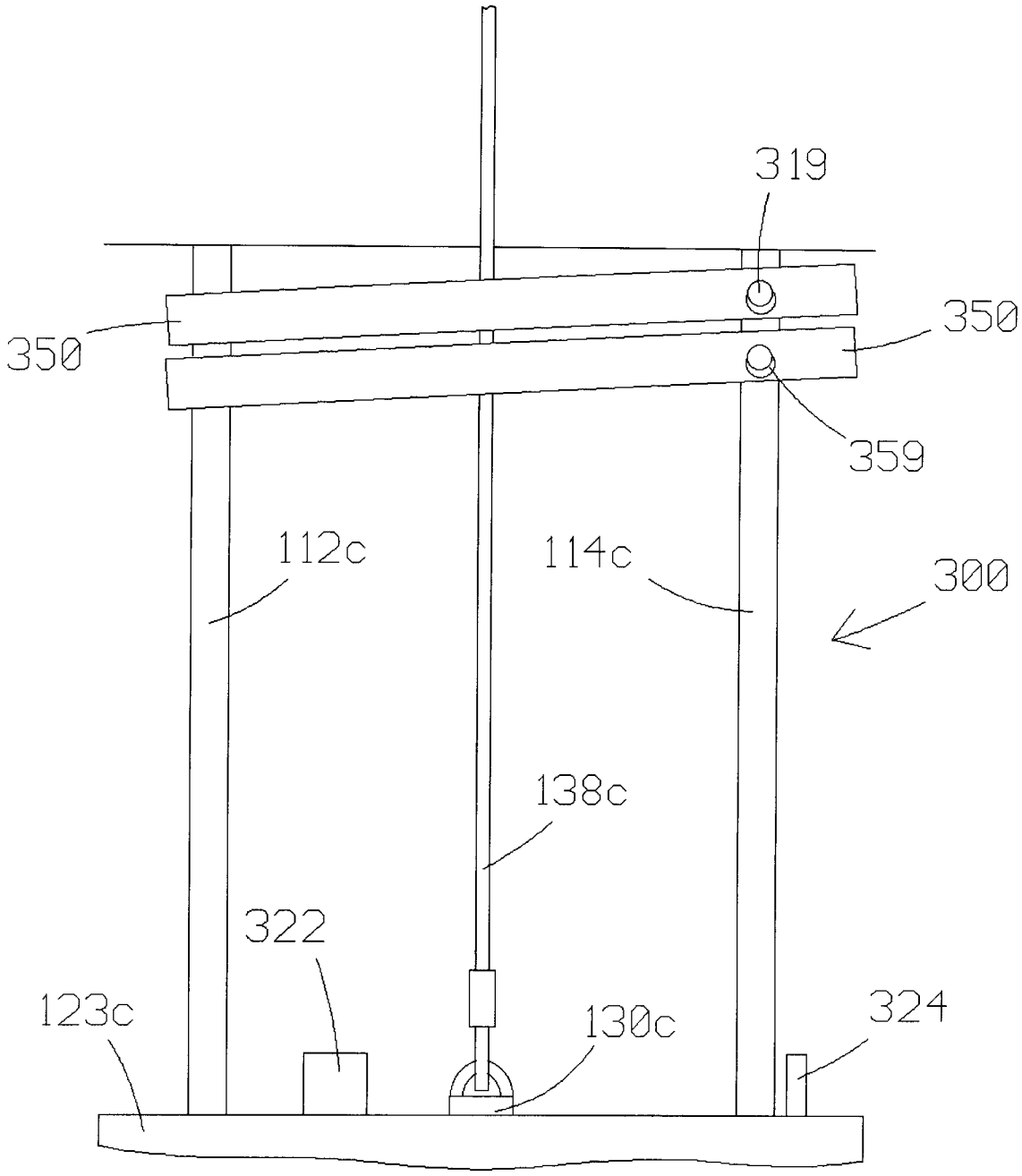
FIG. 6 is a partially fragmented, front view of a third exercise apparatus constructed according to the principles of the present invention.

FIG. 6 shows another weight stack machine 300 which has been assembled in accordance with the principles of the present invention. The machine 300 similarly includes a weight stack, including top plate 123*c*, movably mounted on guide rods 112*c* and 114*c*. A selector rod 130*c* extends through the weight stack and is connected to a force receiving member by means of cable 138*c*.

Figure 7:
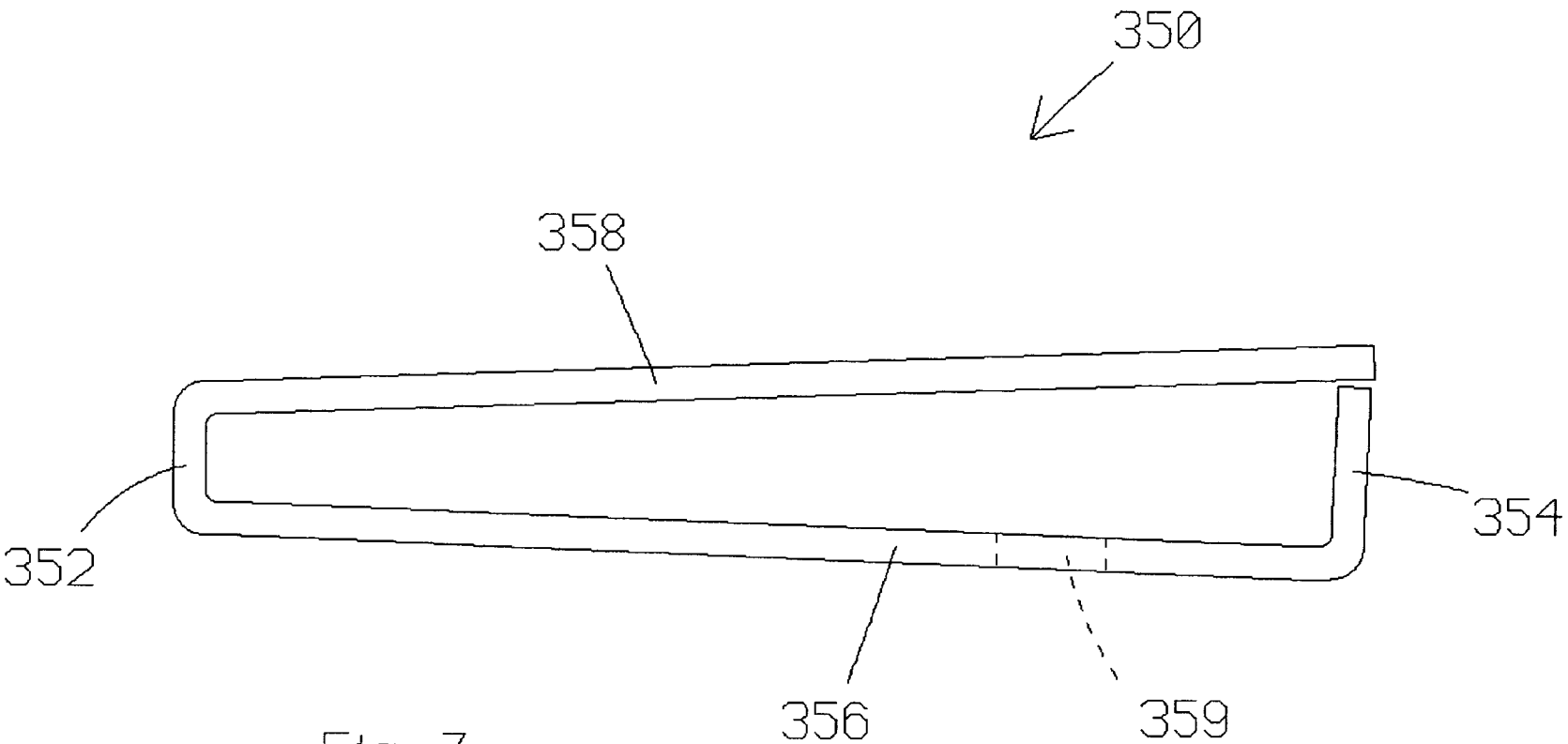
FIG. 7 is a top view of a supplemental weight on the exercise apparatus of FIG. 6.

Supplemental weights 350 are movable along the guide rods 112*c* and 114*c* above the top plate 123*c*. As shown in FIG. 7, each weight 350 is a bar that has been bent or otherwise formed to interact with the guide rods 112*c* and 114*c* and not interfere with the selector rod 130*c* and/or the cable 138*c*.

Each bar 350 may be described as a substantially closed loop having relatively short ends 352 and 354 and relatively long sides 356 and 358. Each loop is sized and configured to fit around both guide rods 112*c* and 114*c*, as well as the connector 138*c*. A hole 359 is formed in the front side 356 of the bar 350, proximate the relatively longer end 354, for reasons explained below.

When the weight 350 is arranged as shown in FIG. 6, the second end 354 is supported by a transversely extending bolt 319 rigidly secured to the guide rod 114*c*, and the first end 352 rests against the guide rod 112*c*. The bolt 319 has a shaft which extends through the hole 359, and a relatively larger diameter head which discourages rotation of the weight 350 about the guide rod 112*c*. The weight 350 is lowered onto the top plate 123*c* by lifting the weight 350 off the bolt 319 and rotating the weight 350 until the front side 356 clears the head of the bolt 319.

Supports or bosses 322 and 324 are provided on the top plate 123*c* to stabilize the weights 350 during exercise. The support 322 has a trapezoidal shape which engages the sides 356 and 358 to discourage movement of the end 352 toward the guide rod 114*c*, and the support 324 has a rectangular shape which engages the end 354 to discourage movement of the end 354 toward the guide rod 112*c*.

Figure 8:
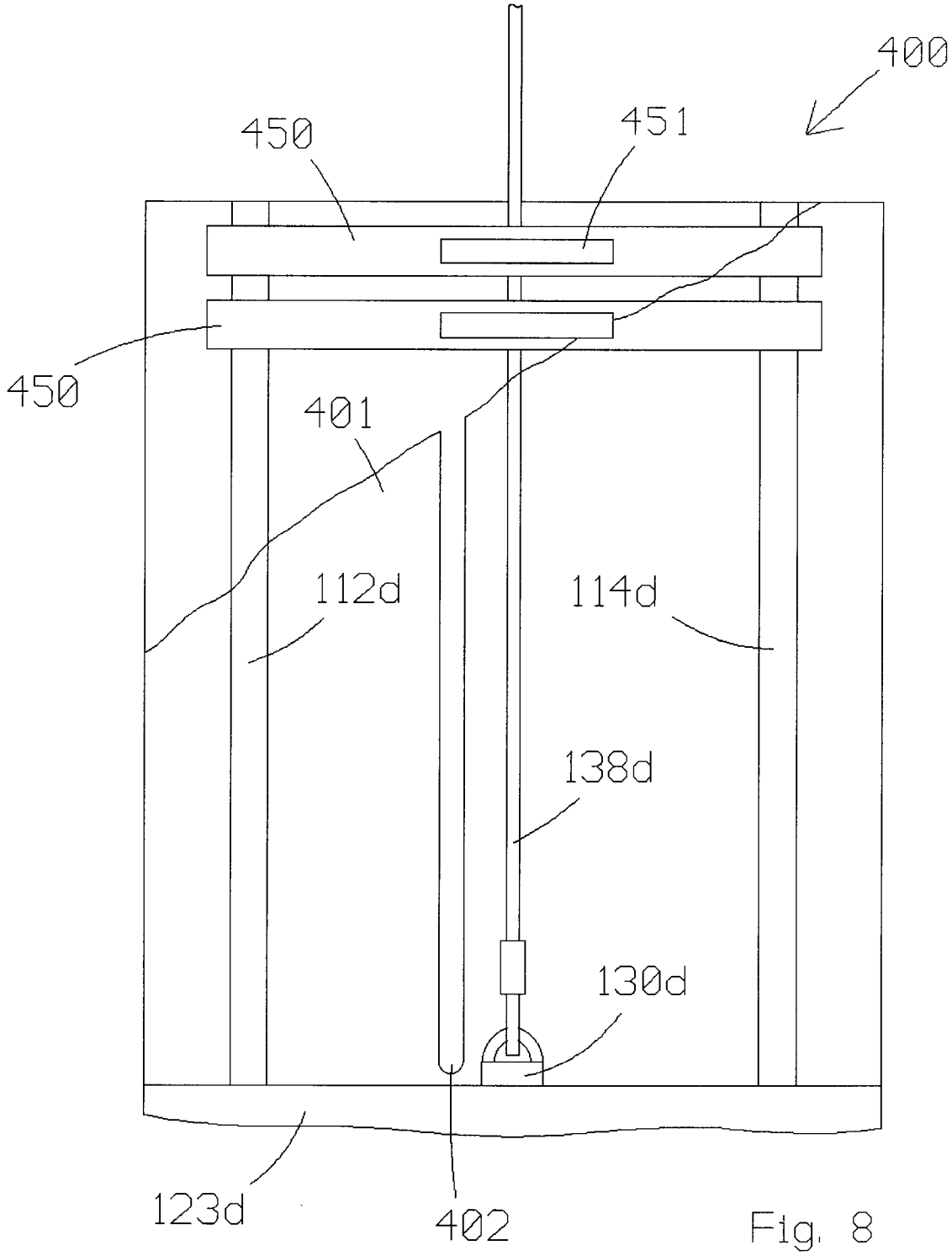
FIG. 8 is a partially fragmented, front view of a fourth exercise apparatus constructed according to the principles of the present invention.

FIG. 8 shows another weight stack machine 400 which has been assembled in accordance with the principles of the present invention. The machine 400 similarly includes a weight stack, including top plate 123*d*, movably mounted on guide rods 112*d* and 114*d*. A selector rod 130*d* extends through the weight stack and is connected to a force receiving member by means of cable 138*d*.

Figure 9:
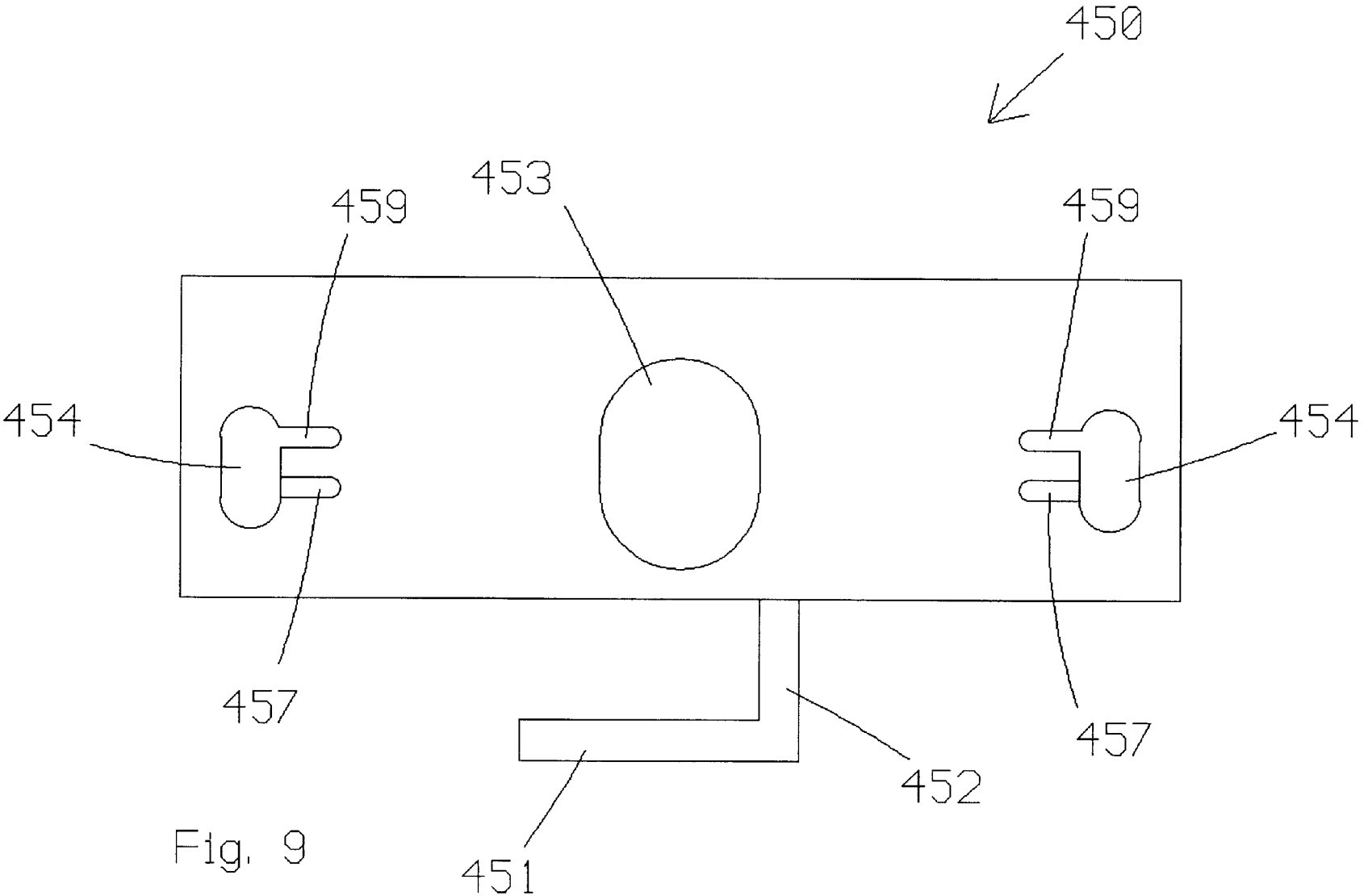
FIG. 9 is a bottom view of a supplemental weight on the exercise apparatus of FIG. 8.

Supplemental weights 450 are movable along the guide rods 112*d* and 114*d* above the top plate 123*d*. Also, a transparent safety shield 401 is provided to substantially cover or enclose the moving parts of the apparatus 400. A slot 402 is provided in the shield 401 to facilitate maneuvering of the supplemental weights 450. As shown in FIG. 9, a shaft 452 is sized and configured to extend through the slot 402 and connect a respective weight 450 (disposed on the far side of the shield 401) to a respective handle 451 (disposed on the near side of the shield 401).

A central hole 453 is formed through the weight 450 to accommodate the cable 138*d* with a significant amount of tolerance. Smaller oval holes 454 are formed through the weight 450 to accommodate the guide rods 112*d* and 114*d*. Pins (not shown) extend transversely from respective guide rods 112*d* and 114*d* and toward one another. Transverse notches 457 are formed in the bottom of the weight 450 to engage respective pins when the weight 450 occupies a first position relative to the guide rods 112*d* and 114*d*. Transverse slots 459 are formed through the weight 450 to accommodate respective pins when the weight 450 occupies a second, transversely displaced position relative to the guide rods 112*d* and 114*d*.

Each weight 450 is lowered onto the top plate 123*d* by pulling the handle 451 forward (toward the reader) and allowing the weight 450 to descend. The shield 401 may be made to cooperate with the shaft 452 in a manner which controls descent of the weight 450 but does not interfere with ascent of the weight 450. Also, the weights 450 (as well as the weights on other embodiments) may be provided with a shock absorbing material or otherwise modified to reduce impact and/or noise during operation.

Figure 10:
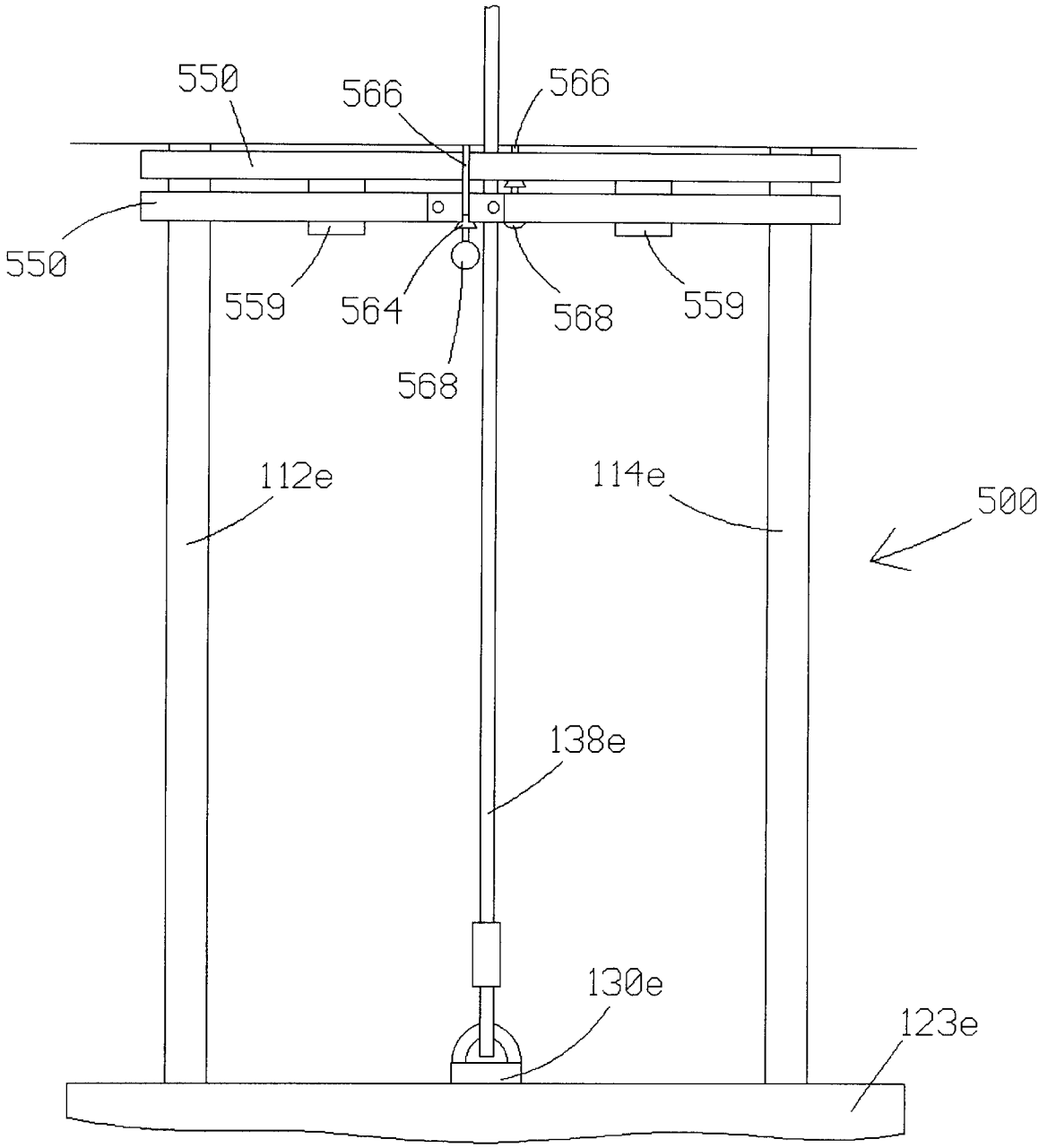
FIG. 10 is a partially fragmented, front view of a fifth exercise apparatus constructed according to the principles of the present invention.

FIG. 10 shows another weight stack machine 500 which has been assembled in accordance with the principles of the present invention. The machine 500 similarly includes a weight stack, including top plate 123*e*, movably mounted on guide rods 112*e* and 114*e*. A selector rod 130*e* extends through the weight stack and is connected to a force receiving member by means of cable 138*e*.

Figure 11:
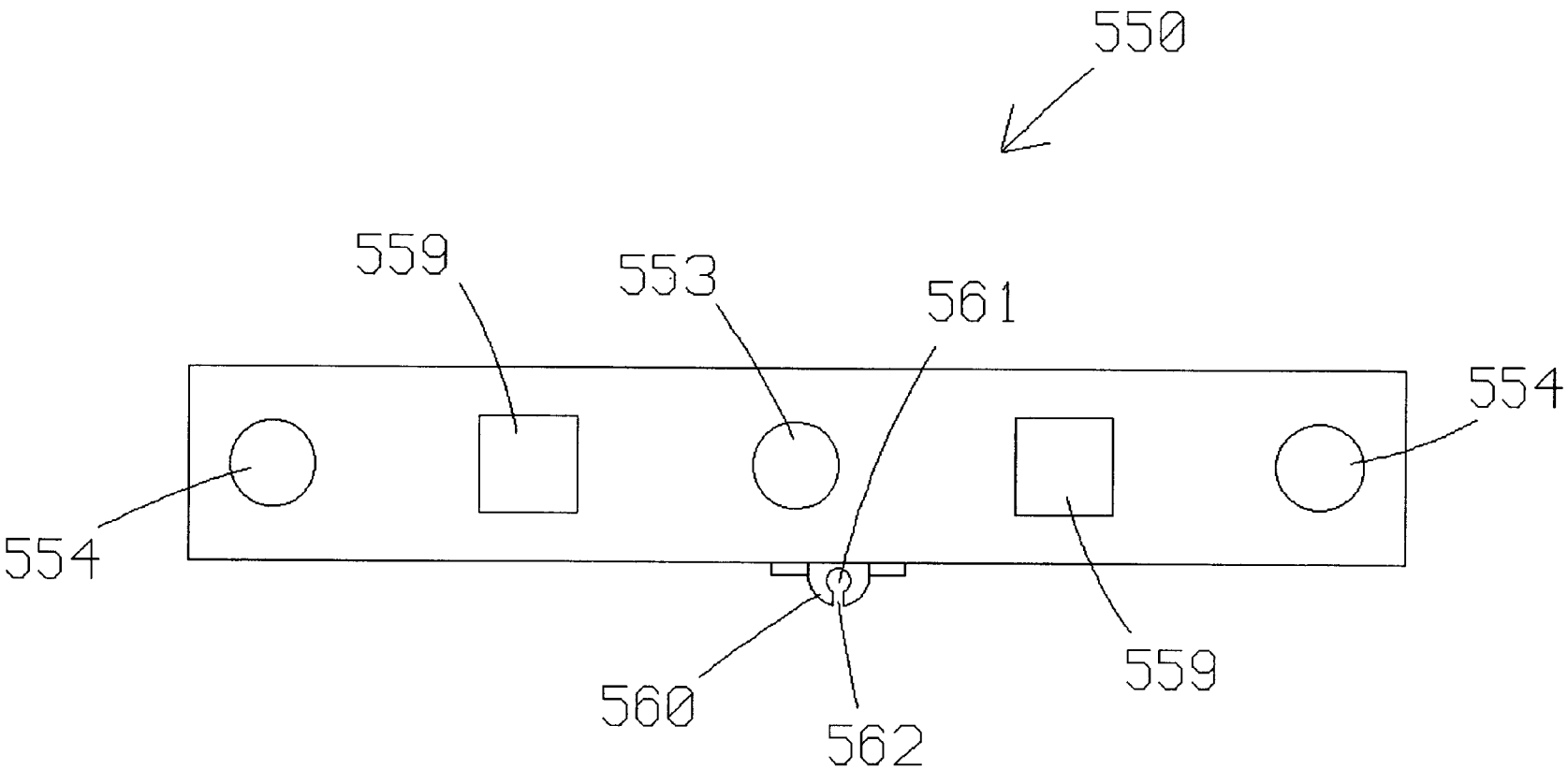
FIG. 11 is a bottom view of a supplemental weight on the exercise apparatus of FIG. 10.

Supplemental weights 550 are movably mounted on the guide rods 112*e* and 114*e* above the top plate 123*e*. As shown in FIG. 11, each weight 550 is a rectangular plate having a central hole 553 to accommodate the selector rod 130*e* and the cable 138*e*, and opposite end holes 554 to accommodate respective guide rods 112*e* and 114*e*. As suggested above with reference to other embodiments, rubber pads 559 are mounted on the bottom of each of these weights 550 to provide a buffer between the two weights 550 and between the lower weights 550 and the top plate 123*e*.

A bracket 560 is mounted on the front side of the lower weight 550, and on the rear side of the upper weight 550 (by bolts, for example). Each bracket 560 provides an upwardly concave or tapered opening 561 which is intersected by a vertical slot 562. A stop 564 having a conical shape is connected to the frame of the apparatus 500 by means of a flexible cord 566. A handle or ball 568 is connected to a distal end of the cord 566 to facilitate maneuvering thereof. The cord 566 is sized and configured to pass through the slot 562, and the stop 564 is sized and configured to occupy the opening 561. The weights 550 may lowered in succession onto the top plate 123*e* by pushing the weight 550 upward, moving the respective cord 566 away from the weight 550, and allowing the weight 550 to descend.

Figure 12:
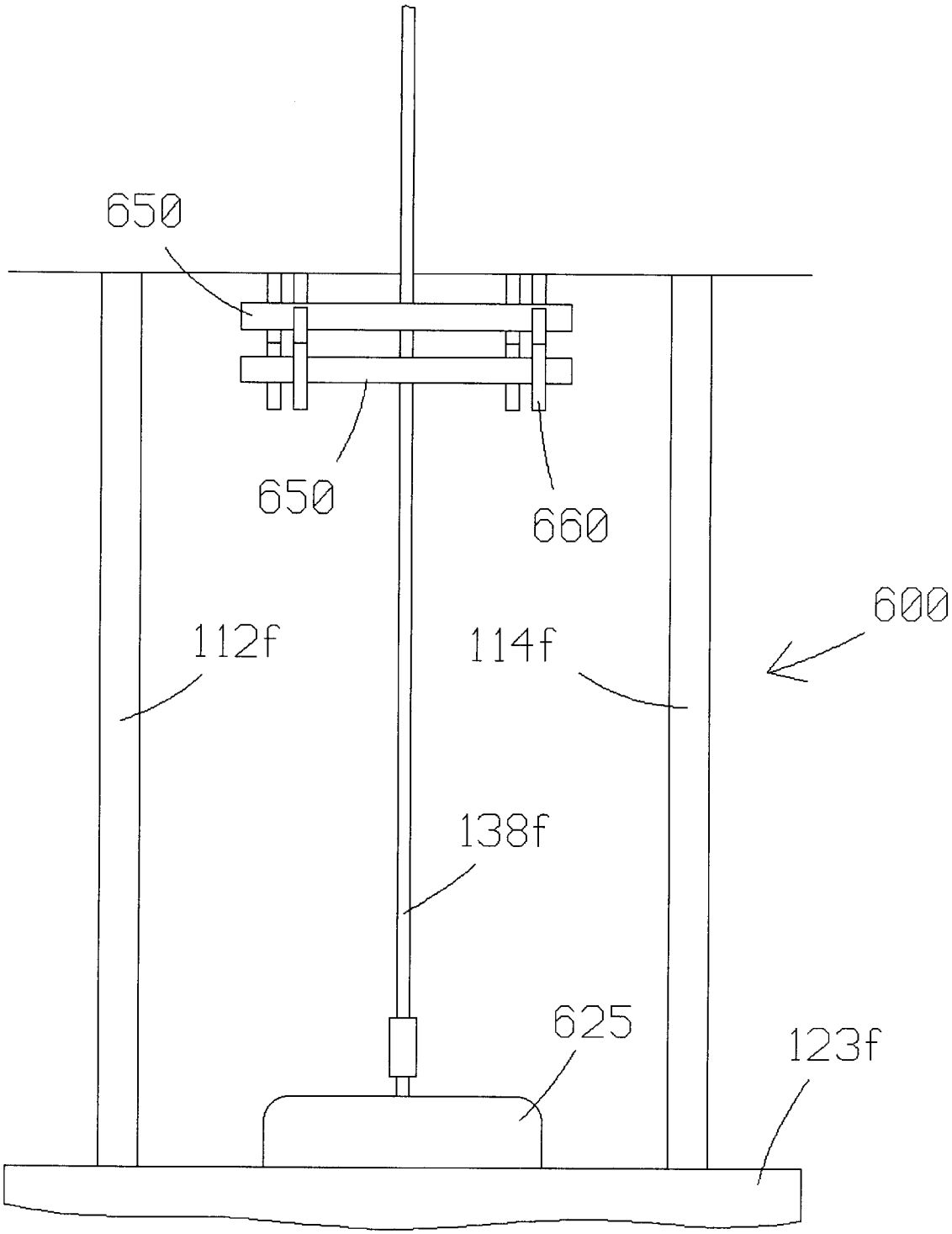
FIG. 12 is a partially fragmented, front view of a sixth exercise apparatus constructed according to the principles of the present invention.

FIG. 12 shows another weight stack machine 600 which has been assembled in accordance with the principles of the present invention. The machine 600 similarly includes a weight stack, including top plate 123*f*, movably mounted on guide rods 112*f* and 114*f*. A selector rod extends through the weight stack and is connected to a force receiving member by means of cable 138*f*.

Supplemental weights 650 are selectively movable onto the top plate 123*f* along a path dictated by cable 138*f*. Each weight 650 forms a substantially closed loop about the cable 138*f*, while the guide rods 112*f* and 114*f* are disposed outside the loops. When lowered onto the top plate 123*f*, each weight 550 fits snugly about a boss or block 625 on the top plate 123*f*. As suggested elsewhere in this description, the block 625 is only one of several positioning or registration devices suitable for use on this embodiment 600 and/or the other embodiments disclosed herein.

Figure 13:
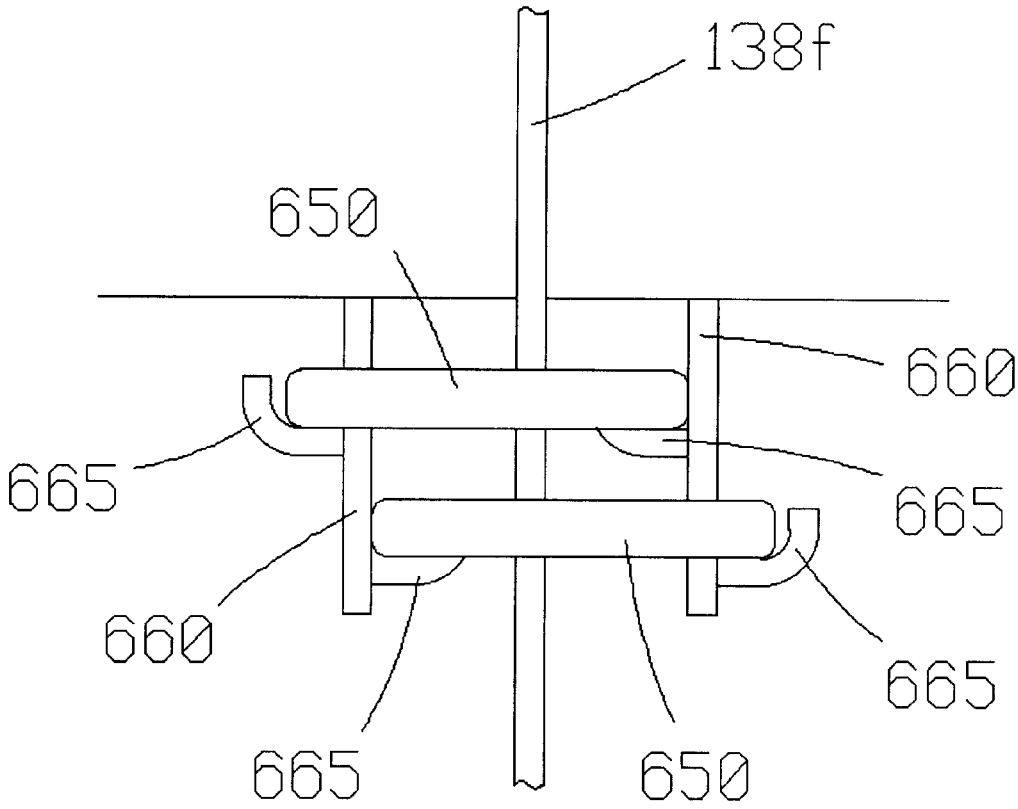
FIG. 13 is a side view of supports and supplemental weights on the exercise apparatus of FIG. 12.

Supports 660 are secured to the frame of the apparatus 600 and extend downward toward the top plate 123*f*. As shown in FIG. 13, the supports 660 provide hooks 665 to selectively retain the weights 650. The lower weight 650 is lowered onto the top plate 123*f* by first moving it upward and rearward (away from the reader) and then moving it downward when free of the hooks 665. This embodiment (and certain other embodiments described herein) may be considered advantageous to the extent that the weights 650 do not engage the guide rods 112*f* and 114*f*, but are still connected to the apparatus 600.

Figure 14:
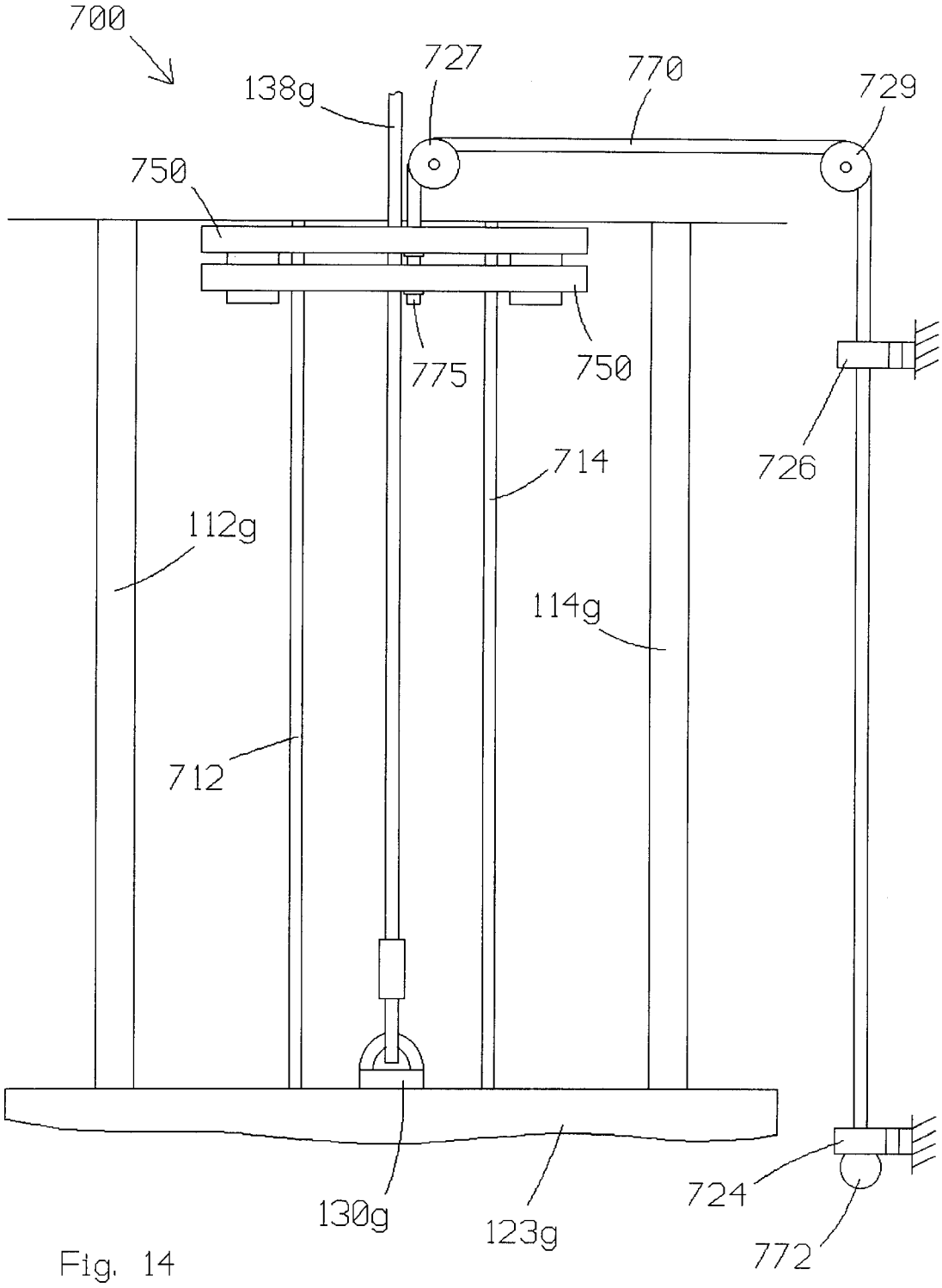
FIG. 14 is a partially fragmented, front view of a seventh exercise apparatus constructed according to the principles of the present invention.

FIG. 14 shows another weight stack machine 700 which has been assembled in accordance with the principles of the present invention. The machine 700 similarly includes a weight stack, including top plate 123*g*, movably mounted on guide rods 112*g* and 114*g*. A selector rod 130*g* extends through the weight stack and is connected to a force receiving member by means of cable 138*g*.

Supplemental weights 750 are selectively movable onto the top plate 123*g* along a path dictated by guide cords 712 and 714, which extend between the frame and the top plate 123*g* (independent of the guide rods 112*g* and 114*g*). In the alternative, the lower ends of the guide cords may be secured to a lower portion of the frame, but modifications would be required. Those skilled in the art will recognize that similar guide cord arrangements may be used together with various other embodiments disclosed herein. Generally speaking, the guide cords guide the supplemental weights between active and inactive positions, but they move with the supplemental weights during exercise activity, as does the connector cable.

Each weight 750 is a rectangular plate having a central hole 753 to provide clearance for the cable 138g and the selector rod 130*g*. Diametrically opposed holes 756 extend through the weights 750 to accommodate respective guide cords 712 and 714. Hole 751 extends through upper weight 750 to facilitate attachment of upper weight 750 to a first weight support 770, and hole 752 extends through upper weight 750 to provide clearance for a second, similar weight support 770 that is attached to lower weight 750. Resilient bumpers 759 are mounted on the bottom of each weight 750.

The supports 770 are connected to the frame of the apparatus 700 by respective pulleys 727 and 729 and respective brackets 724 and 726. A first end of one support 770 is threaded through the holes 752 in the weights 750 and secured to the lower weight 750 by a fastener 775. A first end of the other support 770 is threaded through the hole 751 in the upper weight 750 and secured thereto by another fastener 775. An opposite end of each support 770 is connected to a respective ball or handle 772 which is moved from the bracket 724 to the bracket 726 in order to lower a respective weight 750. This embodiment 700 may be considered advantageous to the extent that the weights 750 may be lowered remotely. Also, the manually operated adjustment mechanism could be replaced by a motor or actuator, for example, to facilitate automated adjustments.

Among other things, the machine 700 may be modified to take up slack in the guide cords as the top plate moves upward. For example, the guide cords may be bungee cords or another suitable elastic material. Another option is to connect the upper ends of the guide cords to respective spring-biased reels. The rewind force of the reel may be offset by adding a counterbalancing amount of mass to the associated supplemental weight.

Figure 16:
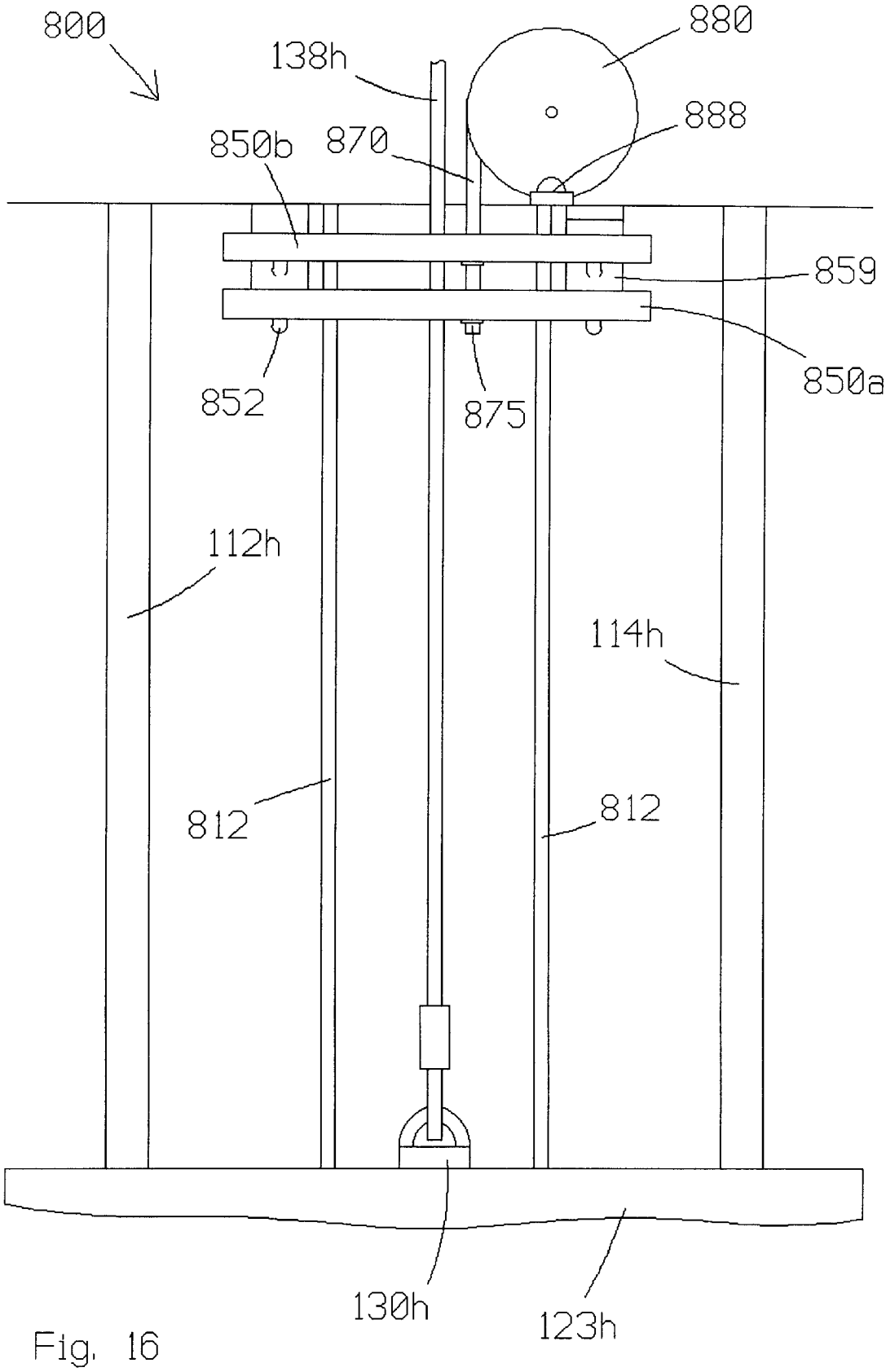
FIG. 16 is a partially fragmented, front view of an eighth exercise apparatus constructed according to the principles of the present invention.

FIG. 16 shows another weight stack machine 800 which has been assembled in accordance with the principles of the present invention. The machine 800 similarly includes a weight stack, including top plate 123*h*, movably mounted on guide rods 112*h* and 114*h*. A selector rod 130*h* extends through the weight stack and is connected to a force receiving member by means of cable 138*h*.

Figure 15:
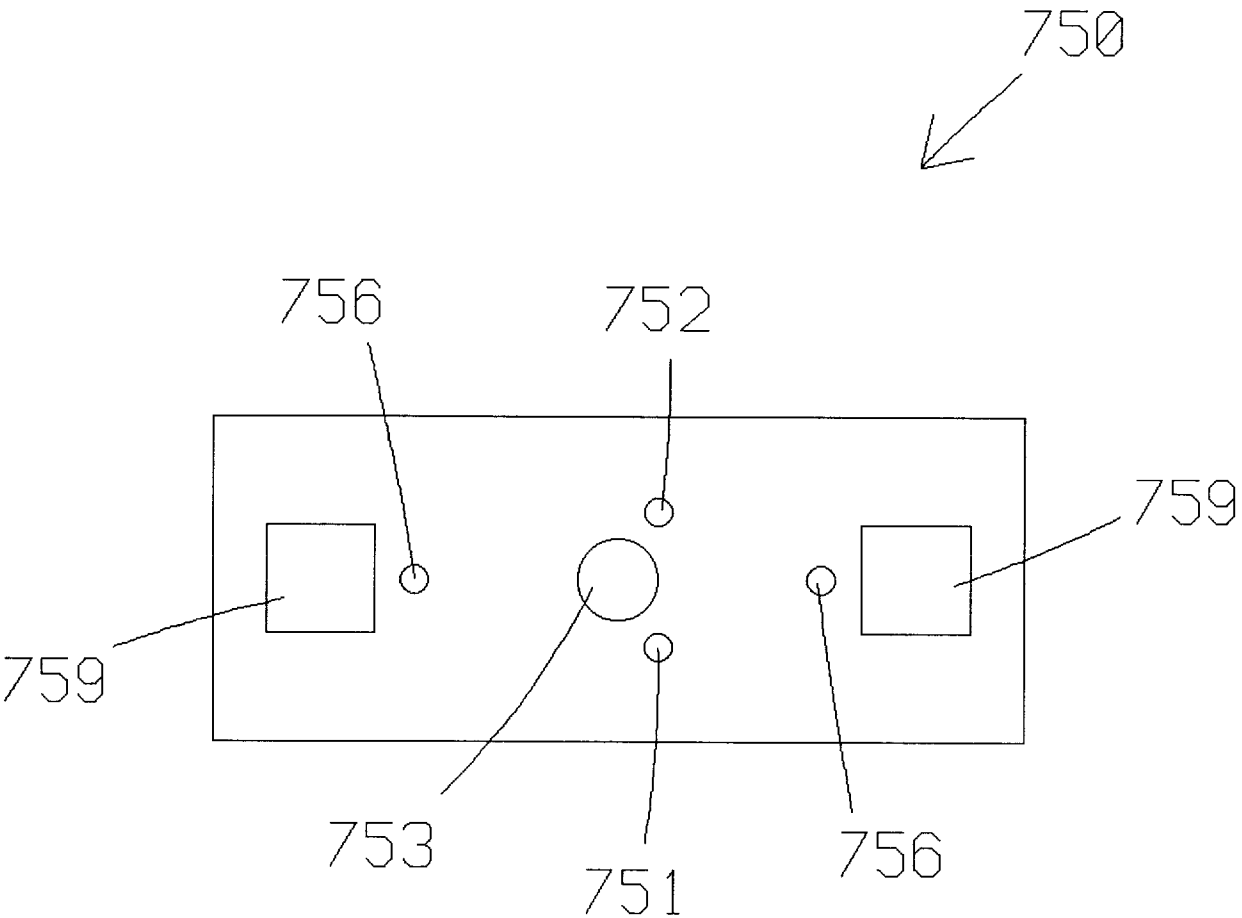
FIG. 15 is a bottom view of a supplemental weight on the exercise apparatus of FIG. 14.

Supplemental weights 850*a* and 850*b* are selectively movable onto the top plate 123*h* along a path dictated by guide cords 812 and 814, which extend between the top plate 123*h* and an upper portion of the frame. The weights 850*a* and 850*b* are similar to the weights 750 shown in FIG. 15, except that (a) relatively larger spacers 859 are disposed on top of each weight 850*a* or 850*b*; (b) pegs 852 extend downward from the weights 850*a* and 850*b* to selectively engage holes extending downward into the top plate 123*h*; and (c) holes extend downward into the weight 850*a* (or the spacers 859 on the weight 850*a*) to selectively receive similar pegs extending downward from the weight 850*b*.

For each of the weights 850*a* and 850*b*, a flexible cord 870 extends between the weight 850*a* or 850*b* and a respective spring-biased reel 880. A first end of each cord 870 is connected to a respective reel 880, and a second, opposite end of each cord 870 is connected to a respective weight 850*a* or 850*b* by means of a fastener 875. The spring force of the reel 880 is sufficiently strong to maintain the weight 850*a* or 850*b* in the raised position. The weight 850*a*, for example, is moved to the lowered position simply by pulling downward, as a latching mechanism 888 (such as a pivoting pawl, for example) releasably locks the reel 880 against rewinding. The latching mechanism 888 may be subsequently released to return the weight 850*a* upward.

An advantage of this embodiment is that the weights 850*a* and 850*b* are not prone to fall toward the top plate 123*h* and possibly cause bodily injury or damage to the machine 800.

Those skilled in the art will recognize that a variety of other known counterbalances may substituted for the spring-biased reels 880.

Figure 17:
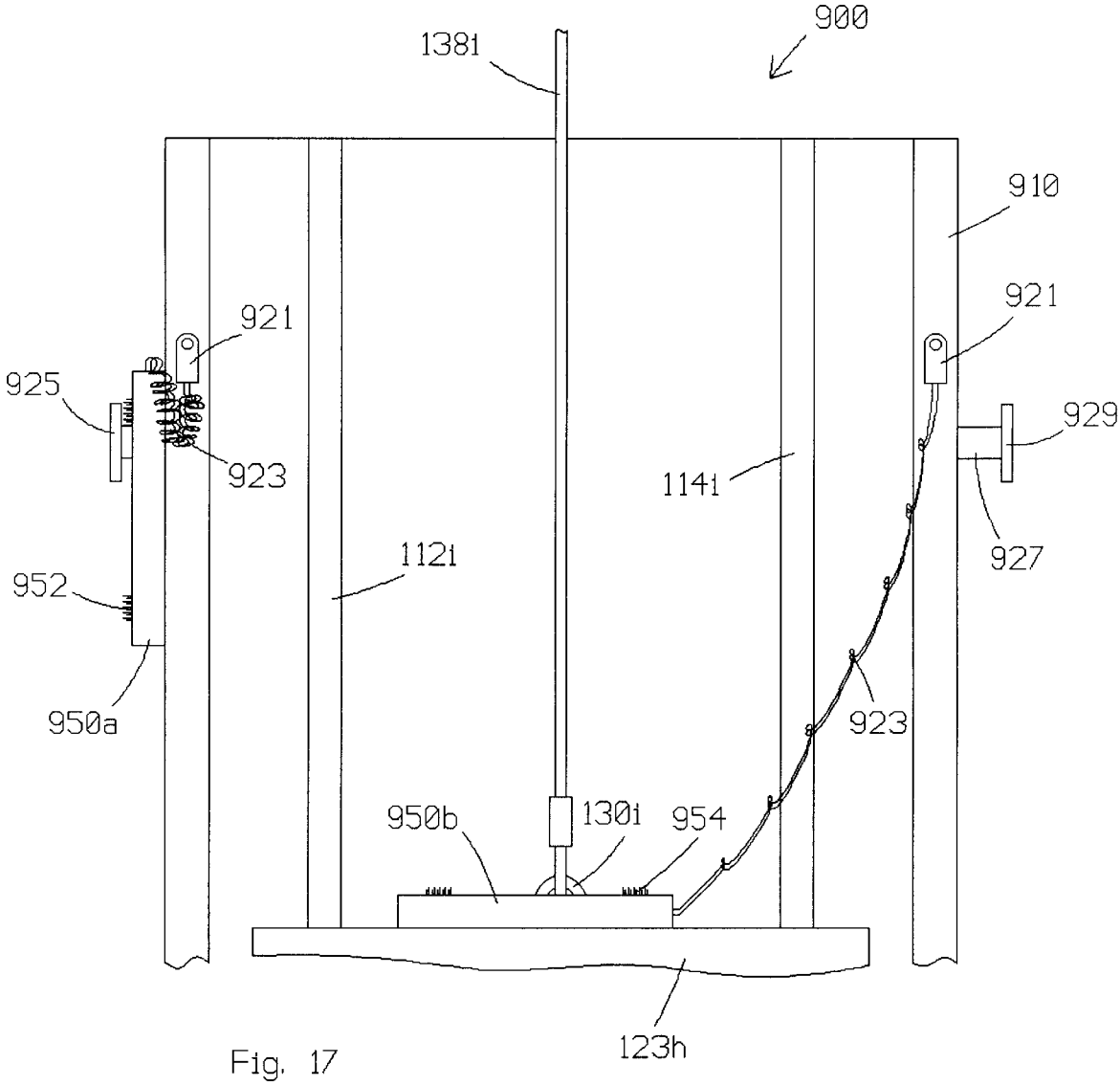
FIG. 17 is a partially fragmented, front view of a ninth exercise apparatus constructed according to the principles of the present invention.

FIG. 17 shows another weight stack machine 900 which has been assembled in accordance with the principles of the present invention. The machine 900 similarly includes a weight stack, including top plate 123*i*, movably mounted on guide rods 112*i* and 114*i*. A selector rod 130*i* extends through the weight stack and is connected to a force receiving member by means of cable 138*i*.

Figure 18:
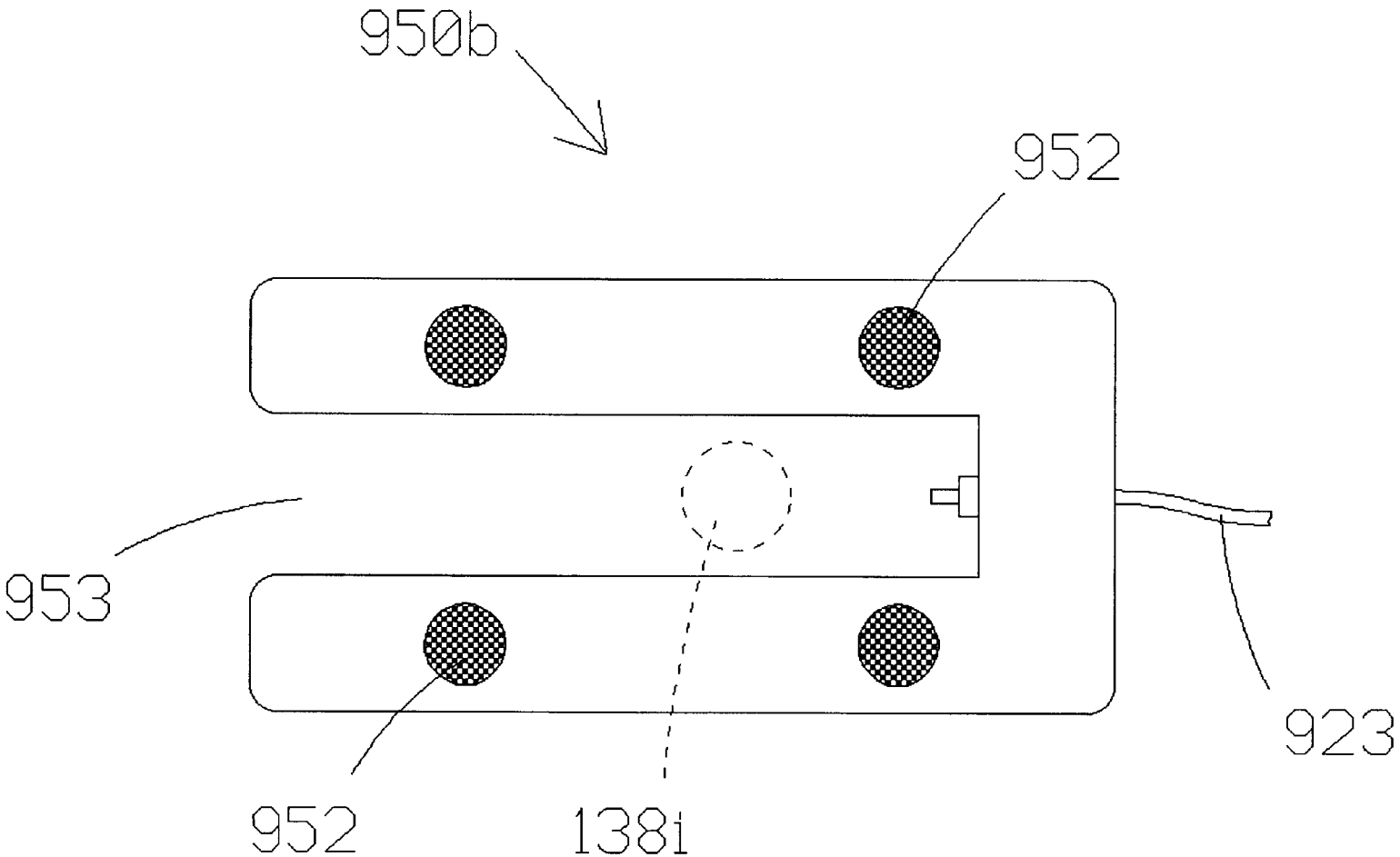
FIG. 18 is a bottom view of a supplemental weight on the exercise apparatus of FIG. 17.

Supplemental weights 950*a* and 950*b* are selectively movable onto the top plate 123*i* along a path limited by respective tethers 923, which extend between the frame 910 and respective weights 950*a* and 950*b*. As shown in FIG. 18, the weight 950*b* (which is representative of the weight 950*a*) is U-shaped to occupy a balanced position relative to the top plate 123*i*, and to provide clearance for the selector rod 138i inside slot 953. Hook type fasteners 952 are mounted on one side of the weight 950*b* to mate with loop type fasteners on the top plate 123*i*. Loop type fasteners 954 are mounted on an opposite side of the weight 950*b* to mate with hook type fasteners on the other plate 950*a* (which also has loop type fasteners on an opposite side, in case the two weights 950*a* and 950*b* are reversed).

The tethers 923 are similar to telephone cords which form a helical coil when free of tension. A first end of each tether 923 is secured to a respective weight 950*a* or 950*b*, and a second, opposite end of each tether 923 is secured to a respective bracket 921 pivotally mounted to the frame 910. Weight supports 925 are secured to the frame 910 to retain the weights 950*a* and 950*b* when not in use. Each support 925 includes a square shaft 927 which fits into the slot 953 in either weight 950*a* or 950*b*, and a flange 929 which spans a portion of either weight 950*a* or 950*b*. Other suitable supports may be used to retain the weights 950*a* and 950*b* on the frame directly above the top plate 123*i*.

Figure 19:
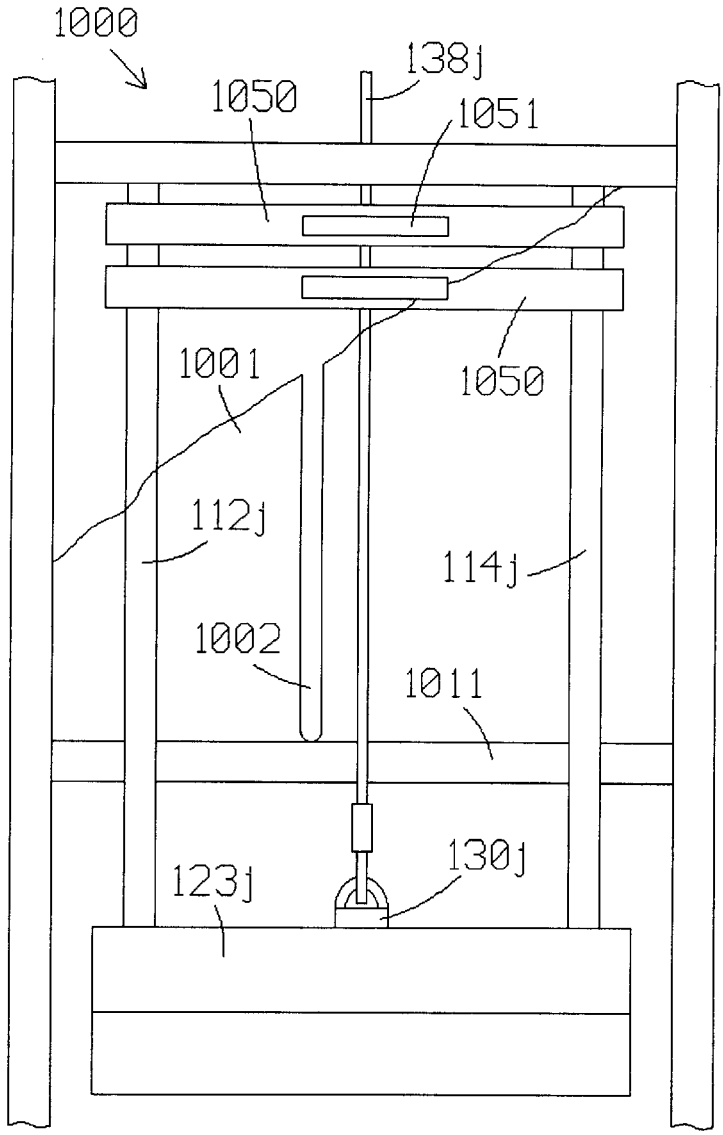
FIG. 19 is a partially fragmented, front view of a tenth exercise apparatus constructed according to the principles of the present invention.

FIG. 19 shows another weight stack machine 1000 which has been assembled in accordance with the principles of the present invention, and which is similar in many respects to the machine 400 shown in FIG. 8. The machine 100 similarly includes a weight stack, including top plate 123*j*, movably mounted on guide rods 112*j* and 114*j*. A selector rod 130*j* extends through the weight stack and is connected to a force receiving member by means of cable 138*j*.

Figure 20:
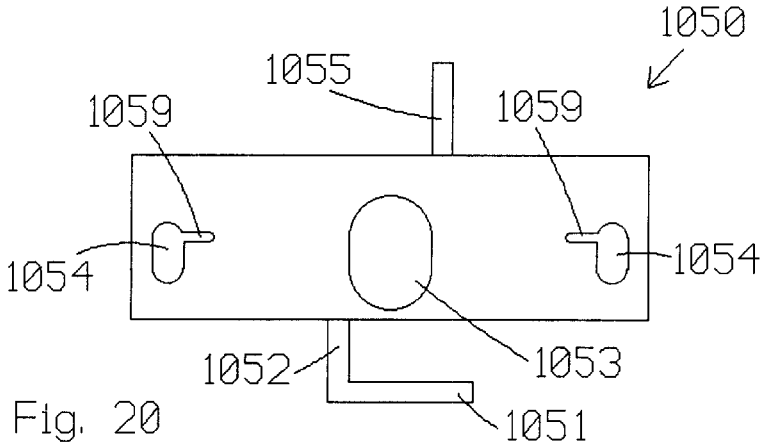
FIG. 20 is a top view of a supplemental weight on the exercise apparatus of FIG. 19.

Supplemental weights 1050 are movably mounted on the guide rods 112*j* and 114*j* above the top plate 123*j*. Also, a safety shield 1001 is provided to substantially cover or enclose the moving parts of the apparatus 1000. A slot 1002 is provided in the shield 101 to facilitate maneuvering of the supplemental weights 1050. As shown in FIG. 20, a shaft 1052 is sized and configured to extend through the slot 1002 and connect a respective weight 1050 to a respective handle 1051 disposed on the near side of the shield 1001 (between the reader and the weights 1050).

A central hole 1053 extends through the weight 1050 to provide clearance for the cable 138j. Smaller oval holes 1054 extend through the weight 1050 to accommodate the guide rods 112*j* and 114*j*. Pins (not shown) extend transversely from respective guide rods 112*j* and 114*j* and toward one another. Transverse notches (not shown) extend into the bottom of the weight 1050 to engage the pins when the weight 1050 occupies a first position relative to the guide rods 112*j* and 114*j*. Transverse slots 1059 extend through the weight 1050 to accommodate the pins when the weight 1050 occupies a second, laterally displaced position relative to the guide rods 112*j* and 114*j*.

Each weight 1050 is lowered toward the top plate 123*j* by pulling the respective handle 1051 forward (toward the reader) and allowing the weight 1050 to descend. The slot 1002 does not extend all the way down to the lowermost position of the top plate 123*j*. Also, a frame member 1011 spans the rear of the machine 1000 and cooperates with a rearwardly extending pin 1055 on each weight 1050 to further limit downward movement of the weights 1050. As a result, each weight 1050 is movable into the path of the top plate 123*j* but is supported by the top plate 123*j* only after the latter has traveled upward a first distance. After the top plate 123*j* reaches the lower extent of the slot 1002, continued upward movement of the top plate 123*j* encounters additional resistance to the extent that any supplemental weights 1050 are within the path of the top plate 123*j*.

Like on the previously described machine 400, the shield 1001 may be made to cooperate with the shaft 1052 in a manner which controls descent of the weight 1050 but does not interfere with ascent of the weight 1050. Also, the weights 1050 (as well as the weights on other embodiments) may be coated with a shock absorbing material or otherwise modified to reduce impact and/or noise during operation. Those skilled in the art will also recognize that similar, intermediate support arrangements may be implemented on other embodiments disclosed herein.

Figure 21:
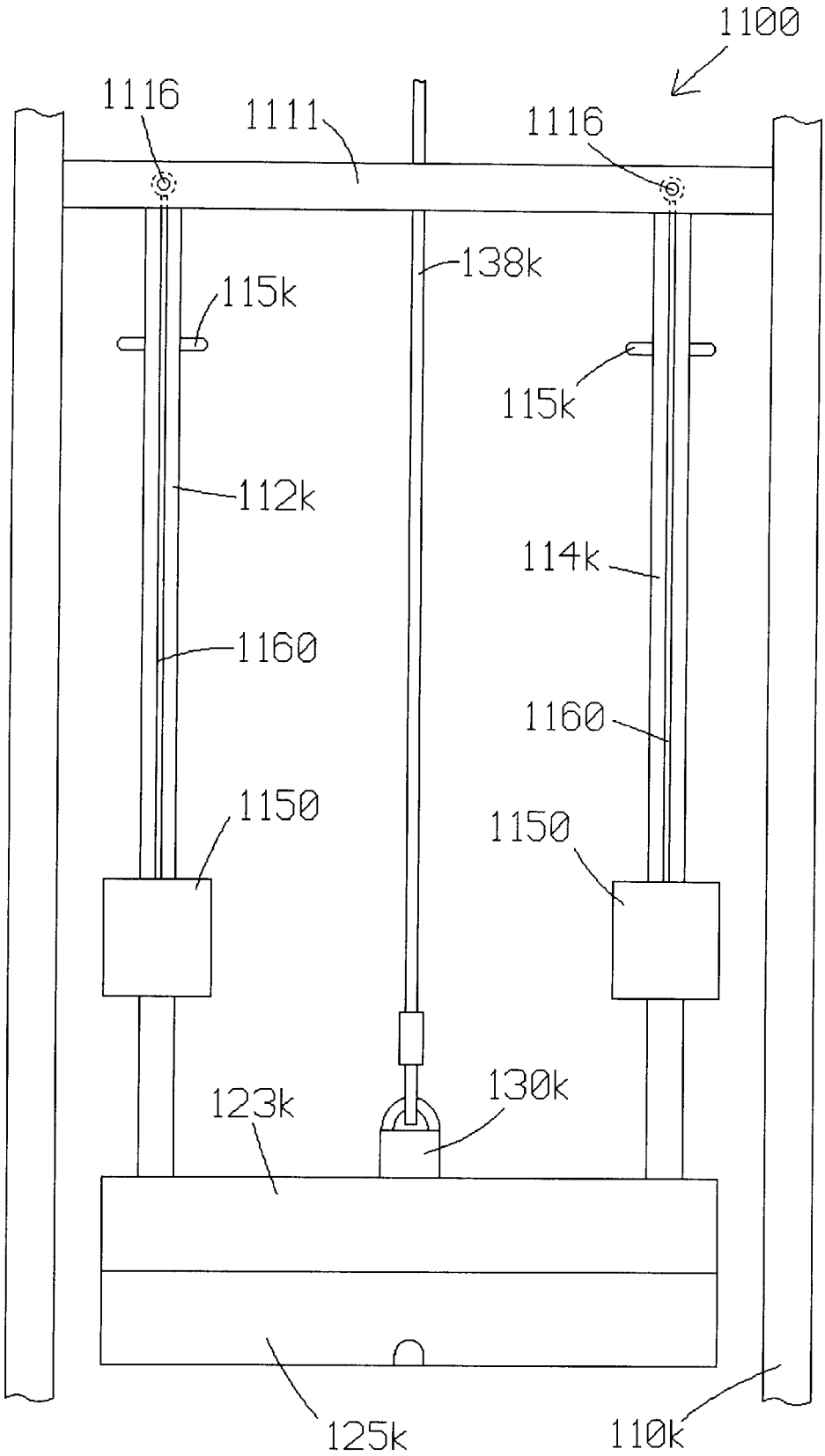
FIG. 21 is a partially fragmented, front view of an eleventh exercise apparatus constructed according to the principles of the present invention.

FIG. 21 shows another weight stack machine 1100 which has been assembled in accordance with the principles of the present invention, and which combines aspects of the foregoing embodiment 1000 and the first embodiment 100. The machine 100 includes a frame 110*k* designed to rest upon a floor surface. First and second guide rods 112*k* and 114*k* extend vertically between lower and upper ends of the frame 110*k*. A top plate 123*k* and underlying weight plates 125*k* are movably mounted on the guide rods 112*k* and 114*k*.

A selector rod 130*k* extends through the plates 123*k* and 125*k* and is selectively connected to any desired plate by a selector pin (or other suitable means known in the art). A cable 138*k* extends from an upper end of the selector rod 130*k* to one or more force receiving members which operate in a manner known in the art. As a result, movement of a force receiving member is resisted by gravity acting on the selected number of plates.

Supplemental weights 1150 are movably mounted on the guide rods 112*k* and 114*k* above the top plate 123*a*. The weights 1150 are configured similar to the weights 150 shown in FIGS. 2–3. A hole extends through each of the weights 1150 to accommodate one of the guide rods 112*k* or 114*k*. A transverse notch extends into the bottom of each weight 1150, and a transverse slot, which extends perpendicular to the notch, extends through each weight 1150.

Each weight 1150 is mounted on a respective guide rod 112*k* or 114*k*. Rigid pins 115*k* are rigidly secured to respective guide rods 112*k* and 114*k* and extend radially outward from the respective guide rods 112*k* and 114*k*. When disposed above a respective pin 115*k*, either weight 1150 may be maneuvered relative to a respective guide rod 112*k* or 114*k* so that the groove in the weight 1150 aligns with the pin 115*k* and thereby biases the weight 1150 against movement relative to the guide rod 112*k* or 114*k*. From this position, either weight 1150 may be maneuvered relative to a respective guide rod 112*k* or 114*k* so that the slot in the weight 1150 aligns with the pin 115*k* and thereby provides clearance for the weight 1150 to move downward beneath the pin 115*k* and into the path of the top plate 123*k*.

Contrary to the weights 150 on the first embodiment 100, the weights 1150 are tethered to the frame by flexible strings

1160. A first end of each string 1160 is connected to a respective weight 1150, and a second, opposite end of each string 1160 is connected to a respective bolt 1116 on a frame member 1111. The lengths of the strings 1160 are such that the weights 150 cannot descend all the way down to the lowermost position of the top plate 123*k*. Rather, the top plate 123*k* encounters any "selected" or activated supplemental weights 1150 only after traveling upward a first distance. Those skilled in the art will recognize that arrangements may be provided to facilitate adjustments to the lengths of the strings (such as respective spools fixed to the front of the frame 110*k* by bolts 1116, for example), and/or that two weights (1150 or 150) may be provided with discrete masses to facilitate three discrete resistance adjustments, including the mass of one weight, the mass of the other weight, and the combined mass of both weights. Those skilled in the art will also recognize that similar weight suspending tether arrangements may be used on other embodiments disclosed herein.

Figure 22:
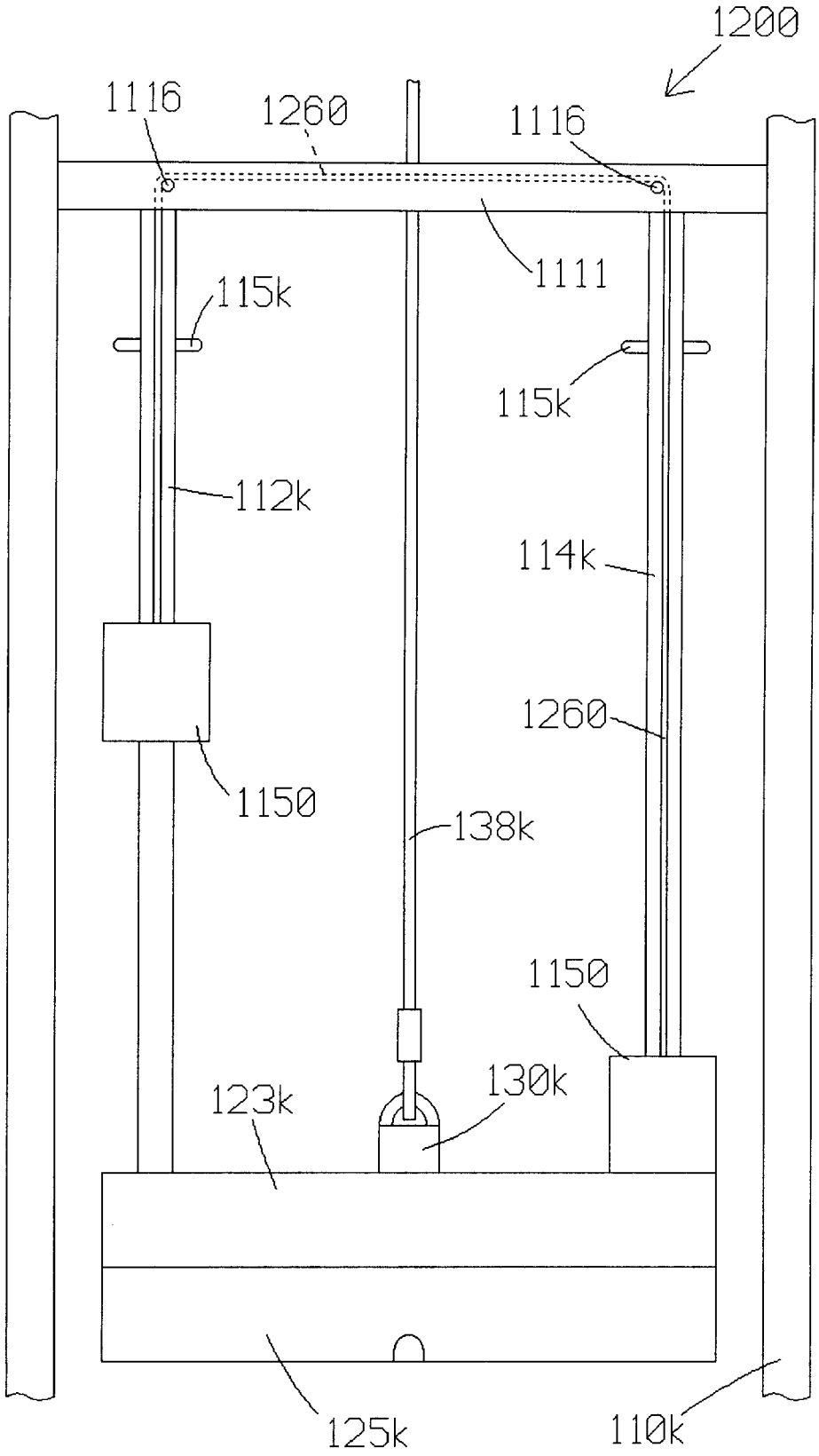
FIG. 22 is a partially fragmented, front view of a twelfth exercise apparatus constructed according to the principles of the present invention.

FIG. 22 shows another weight stack machine 1200 which has been assembled in accordance with the principles of the present invention, and which is similar in many respects to the foregoing embodiment 1100 (as suggested by the common reference numerals). In fact, the only structural distinction regards the manner in which the weights 1150 are tethered. In particular, this embodiment 1200 has a single flexible line 1260 which extends from a first end, which is connected to one of the weights 1150, to an intermediate portion, which is disposed about the bolts 1116, to a second, opposite end, which is connected to the other weight 1150.

The length of the line 1260 is such that both weights 1150 cannot move to the lowermost position of the top plate 123*k* at the same time. As a result of this arrangement, either weight may be moved to the lowermost position, in which case, the other weight is available for descent only to an intermediate position along the path of the top plate 123*k*. Those skilled in the art will recognize that a coupling must be established between the relatively lower weight 1150 and the top plate 123*k* if the relatively lower weight 1150 weighs less than the other weight 1150. For example, hook and loop fasteners, like those shown in FIG. 17, may be provided on the relatively lower weight 1150 and the top plate 123*k*.

Figure 24:
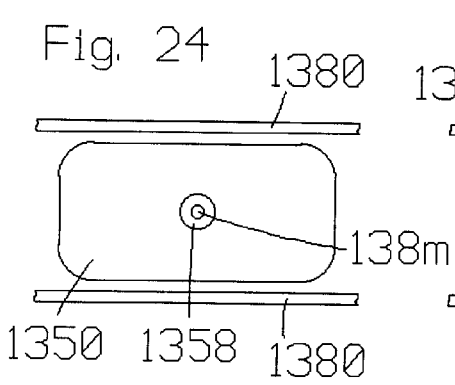
FIG. 24 is a partially fragmented, top view of a supplemental weight occupying a first orientation relative to a frame member on the exercise apparatus of FIG. 23.
Figure 25:
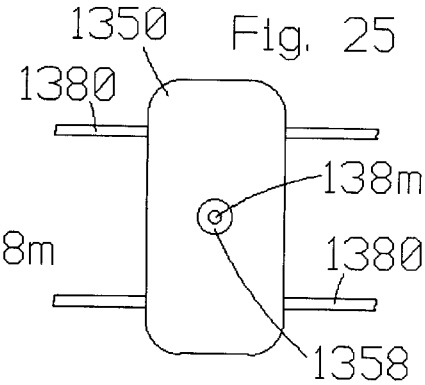
FIG. 25 is a partially fragmented, top view of the supplemental weight of FIG. 24 occupying a second orientation relative to the frame member of FIG. 24.
Figure 23:
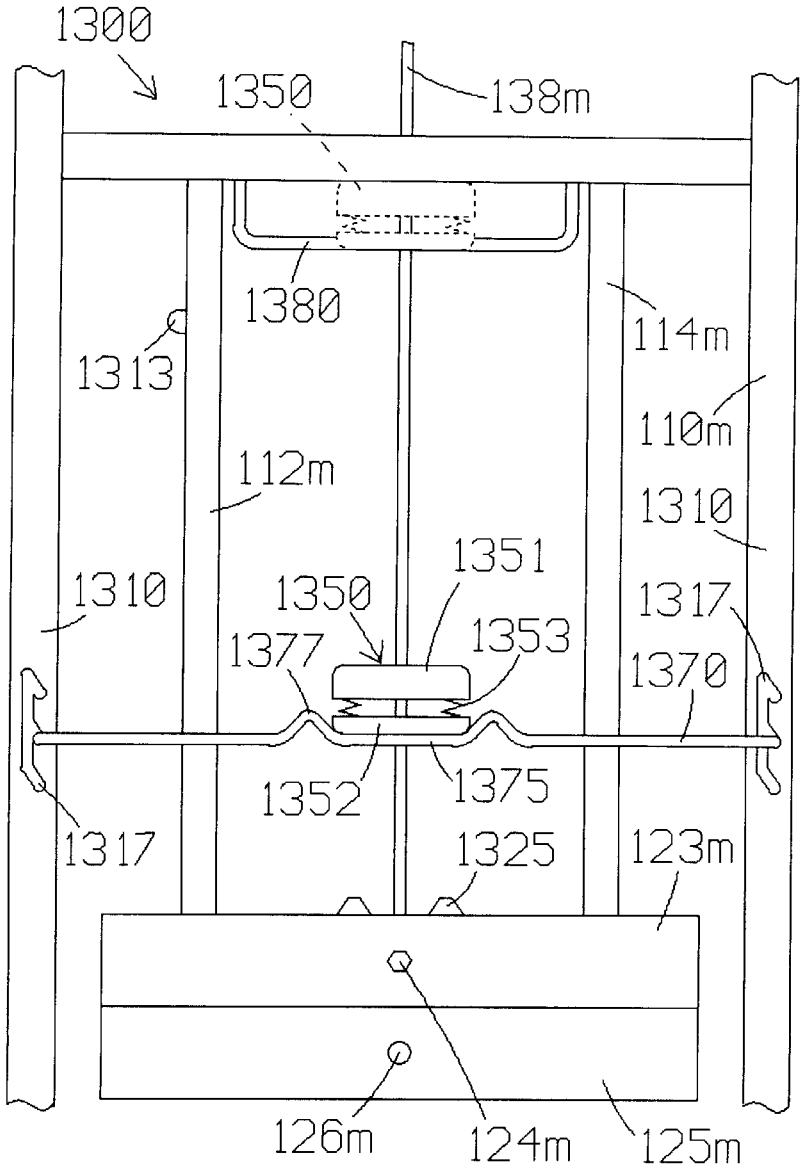
FIG. 23 is a partially fragmented, front view of a thirteenth exercise apparatus constructed according to the principles of the present invention.

FIGS. 23–25 show another weight stack machine 1300 which has been assembled in accordance with the principles of the present invention. The machine 1300 similarly includes a weight stack, including top plate 123*m*, movably mounted on guide rods 112*m* and 114*m*. A connector or cable 138*m* is interconnected between the top plate 123*m* and a force receiving member. In a manner known in the art, a selector rod (not shown) extends through the weight stack and is rigidly secured to the top plate 123*m* by means of a bolt 124*m*. The selector rod is selectively connected to underlying weight plates 125*m* by means of a selector pin (not shown) inserted through a respective hole 126*m*.

In the absence of tension in the cable 138*m*, the top weight plate occupies a lowermost position relative to the frame 110*m*. In response to a sufficiently large pulling force on the cable 138*m*. the top weight plate 123*m* moves upward to an uppermost position (which is typically determined by range of motion associated with an exercise, but may be more positively determined by a stop 1313 on guide rod 112*m*, for example). A supplemental weight 1350 is selectively movable along the cable 138*m* from an inactive position on a frame member 1380 (above the uppermost position of the top weight plate 123*m*), to an active position on a frame member 1370 (between the uppermost and lowermost positions of the top weight plate 123*m*), to an active position on the top weight plate 123*m* (at the lowermost position of the top weight plate 123*m*). The cable 138*m* extends through a central opening 1358 in the weight 1350, and the weight 1350 may be described as forming a substantially closed loop about the cable 138*m* (to the exclusion of the guide rods 112*m* and 114*m*).

The weight 1350 includes an upwardly disposed block 1351 and a downwardly disposed plate 1352 which are interconnected by helical coil springs 1353. The block 1351 constitutes the majority of the mass on the weight 1350, and the plate 1352 is configured to interface with the top weight plate 123*m*. In particular, cavities or depressions are formed in the downwardly facing side of the plate 1352 to receive the upwardly tapered nubs 1325 on the top plate 123*m* when the weight 1350 is oriented as shown in FIG. 24. The downwardly opening cavities are identical to those shown in FIGS. 26–27 with reference to an alternative weight 1450.

The frame member 1380 includes two adjacent U-shaped bars which are configured generally as shown in FIG. 23, and which are spaced relative to one another (and the weight 1350) as shown in FIGS. 24–25. As a result, when the weight 1350 is oriented as shown in FIG. 24, it is free to move past the frame member 1380, and when the weight is oriented as shown in FIG. 25, it is captured or blocked by the frame member 1380. The spatial relationship between the frame member 1380 and the frame 110*m* is such that the springs 1353 must be compressed in order to move the weight 1350 into and out of the position shown in dashed lines in FIG. 23. As a result of this arrangement, the weight 1350 is maintained in a safe and quiet storage location when not in use; a user must handle the weight 1350 in order to lower to an operative location; and the weight 1350 is connected to the apparatus 1300 without engaging either of the guide rods 112*m* and 114*m*.

The frame member 1370 includes a single bar formed into a generally rectangular configuration, having two "contoured" sides like the portion shown in FIG. 23 and two linear sides which extend through the frame 110*m*. The spacing between the two contoured sides of the frame member 1370 is similar to the spacing of the two bars which form the frame member 1380, and thus, the weight 1350 is similarly maneuverable relative thereto. Each of the two contoured sides of the frame member 1370 has a straight central portion 1375 bounded at each end by guides or humps 1377. This arrangement is designed to support the weight 1350 in an aligned position relative to the top weight plate 123*m*. The sides of the plate 1352 cooperate with the humps 1377 to "center" the weight 1350 in a direction parallel to the central portions 1375, and grooves in the underside of the plate 1352 cooperate with the central portions 1375 to "center" the weight 1350 along a direction perpendicular to the central portions 1375.

An optional means may be provided for purposes of adjusting the rest position established by the frame member 1370. For example, openings 1317 may be provided in the vertical frame members 1310 (in the manner shown in FIG. 23) to accommodate vertical movement of the straight sides of the frame member 1370 and to support same at a plurality of vertically displaced locations. Moreover, the openings 1317 may be extended all the way up the frame members 1310, thereby eliminating the need for a separate frame member 1380. In other words, a user may alternatively be required to move the weight support, rather than the supplemental weight, for purposes of activation and deactivation.

In operation, the apparatus 1300 facilitates multiple modes of operation. For example, when the weight 1350 occupies the position shown in dashed lines in FIG. 23, the apparatus 1300 functions like a conventional weight stack machine. If the weight 1350 is moved to the position shown in solid lines in FIG. 23, the amount of weight resistance increases in the middle of an exercise stroke. In other words, the user is lifting the weight of the conventional stack until the top weight plate 123*m* moves upward into contact with the supplemental weight 1350. During this contact phase, the springs 1353 absorb energy and/or reduce impact of the top weight plate 123*m* against the supplemental weight 1350 to provide a relatively smooth transition into a relatively greater amount of weight resistance. After the weight 1350 is lifted from the frame member 1370 (and supported by the top weight plate 123*m*), the user is lifting the weight of the conventional weight stack and the supplemental weight 1350. In the alternative, if the weight 1350 is lowered onto the top plate 123*m* (when the latter occupies its lowermost position), the user is lifting the weight of the conventional stack and the supplemental weight 1350 throughout the range of exercise motion.

FIGS. 26–27 show another weight stack machine 1400 which has been assembled in accordance with the principles of the present invention (and is similar in many respects to the previous embodiment 1300). The machine 1400 similarly includes a weight stack, including top weight plate 123*m*, movably mounted on guide rods 112*n* and 114*n*. A connector or cable 138*n* is interconnected between the top weight plate 123*m* and a force receiving member 140*n*. The cable 138*n* is routed about a couple of pulleys 139*n* so that downward and/or outward movement of the force receiving member 140*n* causes upward movement of the top weight plate 123*m*. This force receiving member arrangement may be considered representative of the other embodiments disclosed herein.

The apparatus 1400 includes two supplemental weights 1450 and 1460, each of which may be described as a simple block or unitary member. The two weights 1450 and 1460 are identical except for upwardly tapered nubs 1456 which are provided on top of only the lower weight 1450. These nubs 1456 interact with the upper weight 1460 in the same manner as the nubs 1325 on the top weight plate 123*m* interact with the lower weight 1450. As shown in FIG. 27, four inwardly tapered cavities or depressions 1455 are provided in the downwardly facing surface of the weight 1450 (and the weight 1460) to interengage the nubs 1325 (or the nubs 1456).

A central opening 1458 extends through each of the weights 1450 and 1460, and the cable 138*n* extends through the openings 1458. Each of the weights 1450 and 1460 may also be described as forming a substantially closed loop about the cable 138*n* (to the exclusion of the guide rods 112*n* and 114*n*). Grooves 1457 are provided in the downwardly facing surface of the weight 1450 (and the weight 1460) to interengage with either the frame member 1370 or the frame member 1480. Each of the grooves 1457 is relatively deeper along a line extending vertically through the groove in FIG. 27. The flared ends of the grooves 1457 guide the weights 1450 and 1460 into proper alignment with a respective frame member 1370 or 1480.

The apparatus 1400 is depicted with the same adjustable frame member 1370 as the previous embodiment 1300. On either embodiment, the frame member 1370 may be provided with one or more downwardly extending bars to discourage rotation of the supplemental weight(s) into an orientation other than that shown for the weight 1450 in FIG. 26. A different upper frame member 1480 is provided in order to accommodate the two weights 1450 and 1460 and provide clearance for the central pulley 139*n*. The frame member 1480 has the same general configuration as the frame member 1380 on the previous embodiment 1300, but with an additional ledge or shelf 1486 for the additional weight 1460, and additional clearance for maneuvering the two weights 1450 and 1460 into and out of engagement.

The top weight plate 123*m* is shown in its lowermost position, and it is movable to an uppermost position (which is determined by stop 1415 on the frame 110*n*). The frame member 1480 is disposed above the uppermost position, and the frame member 1370 is disposed between the uppermost position and the lowermost position. The existence of multiple supplemental weights 1450 and 1460 allows this embodiment 1400 to function in yet another mode of operation, wherein the user lifts the weight of the conventional weight stack and the supplemental weight 1450 through the entire range of exercise motion, and the amount of weight is increased by the supplemental weight 1460 during the exercise stroke.

FIGS. 28–29 show another weight stack machine 1500 which has been assembled in accordance with the principles of the present invention. The machine 1500 similarly includes a weight stack, including top plate 123*p*, movably mounted on guide rods 112*p* and 114*p*. The connector 138*n* is interconnected between the top plate 123*p* and the force receiving member 140*n* in the same manner as on the previous embodiment 1400. In a manner known in the art, a selector rod (not shown) extends through the weight stack and is rigidly secured to the top plate 123*p* by means of a bolt 124*p*. The selector rod is selectively connected to underlying weight plates 125*p* by means of a selector pin (not shown) inserted through a respective hole 126*p*.

In the absence of tension in the cable 138*n*, the top weight plate occupies a lowermost position relative to the frame 110*p*. In response to a sufficiently large pulling force on the cable 138*n*, the top weight plate 123*p* moves upward to an uppermost position (which may be determined by stop 1515 on the frame 110*p*, for example). A supplemental weight 1550 is selectively movable along the cable 138*n* from an inactive position (supported by a cable 1590 above the uppermost position of the top weight plate 123*p*), to any of several intermediate active positions (supported by the cable 1590 between the uppermost and lowermost positions of the top weight plate 123*p*), to a lowermost active position (resting on the top weight plate 123*p* when the latter is at its lowermost position).

The support cable 1590 extends from a first end, connected to a fastener 118*p* on the frame 110*p*, to a first intermediate portion disposed about a pulley 1559 on the weight 1550 (and supported by another fastener 119*p* on the frame 110*p*), to a second intermediate portion disposed about a pulley 139*p* on the frame 110*p*, to a second end, connected to a detent pin 1595. The detent pin 1595 is inserted into any one of several holes spaced along the frame member 1510. A stop 1599 is mounted on the first intermediate portion of the cable 1590, proximate the first end of the cable 1590, to limit upward travel of the weight 1550 caused by a user pulling on the cable 1590.

The weight 1550 includes an upwardly disposed block 1551 and a downwardly disposed plate 1552 which are interconnected by a rubber bumper 1553. The block 1551 constitutes the majority of the mass on the weight 1550, and the plate 1552 is configured to interface with the top weight plate 123*p*. In particular, the plate 1552 is downwardly tapered in order to readily align with an upwardly tapered cavity or depression 1522 in the top plate 123*p*. A bracket

1557 extends upward from the block 1551 to support the pulley 1559. A hole 1558 extends through both the block 1551 and the plate 1552 to receive the cable 138*n*, and as a result, the weight 1550 forms a substantially closed loop about the cable 138*n*. On this embodiment 1500, the weight 1500 could be configured to surround and/or travel along the guide rods 112*p* and 114*p* and/or a flexible guide cord, either in combination or in the alternative. The positioning of the opening 1558 and the pulley 1559 on the weight 1550 is a matter of design choice, which may be influenced by both a desire to center the mass of the weight 1550 relative to the center of the top weight plate 123*p*, and a desire to center the mass of the weight 1550 relative to the longitudinal axis of the cable 138*n*.

On all of the embodiments 1300, 1400, and 1500, the openings through the supplemental weights are significantly larger in diameter than the diameter of the connecting cable to facilitate unencumbered movement of one relative to the other. On the embodiment 1500, the relationship between the supplemental weight 1550 and the connector cable 138*n* is more critical because no stationary support is provided for the weight 1550. As a result, contact is likely to occur between the suspended weight 1550 and the cable 138*p*. Therefore, the balance of the weight 1550, the size of the opening 1558, and the selection of the interfacing materials on the weight 1550 and the cable 138*p* are significant design considerations. One possibility is to use a plastic coated cable for the cable 138*n*, and chromed steel for the weight 1550. Another possibility is to use a bare steel cable for the cable 138*n*, and UHMW plastic for the weight 1550 (or at least the walls disposed about the opening 1558 through the weight 1550).

The embodiment 1500 may be viewed as advantageous because it requires fewer additional frame members and offers significant convenience, safety, and/or flexibility in the positioning of the weight 1550 relative to the top weight plate 123*p*. Moreover, the design of the apparatus 1500 is suitable for simple conversion between different types of machines, depending upon the preferences of the designer. For example, the pin locations along the frame member 1510 may be limited in such a manner that fractional resistance increase is available only throughout the range of exercise motion; or the pin locations may be such that fractional resistance increase is available only after initiation of an exercise stroke; and/or both pin locations may be available to facilitate both modes of operation.

Figure 39:
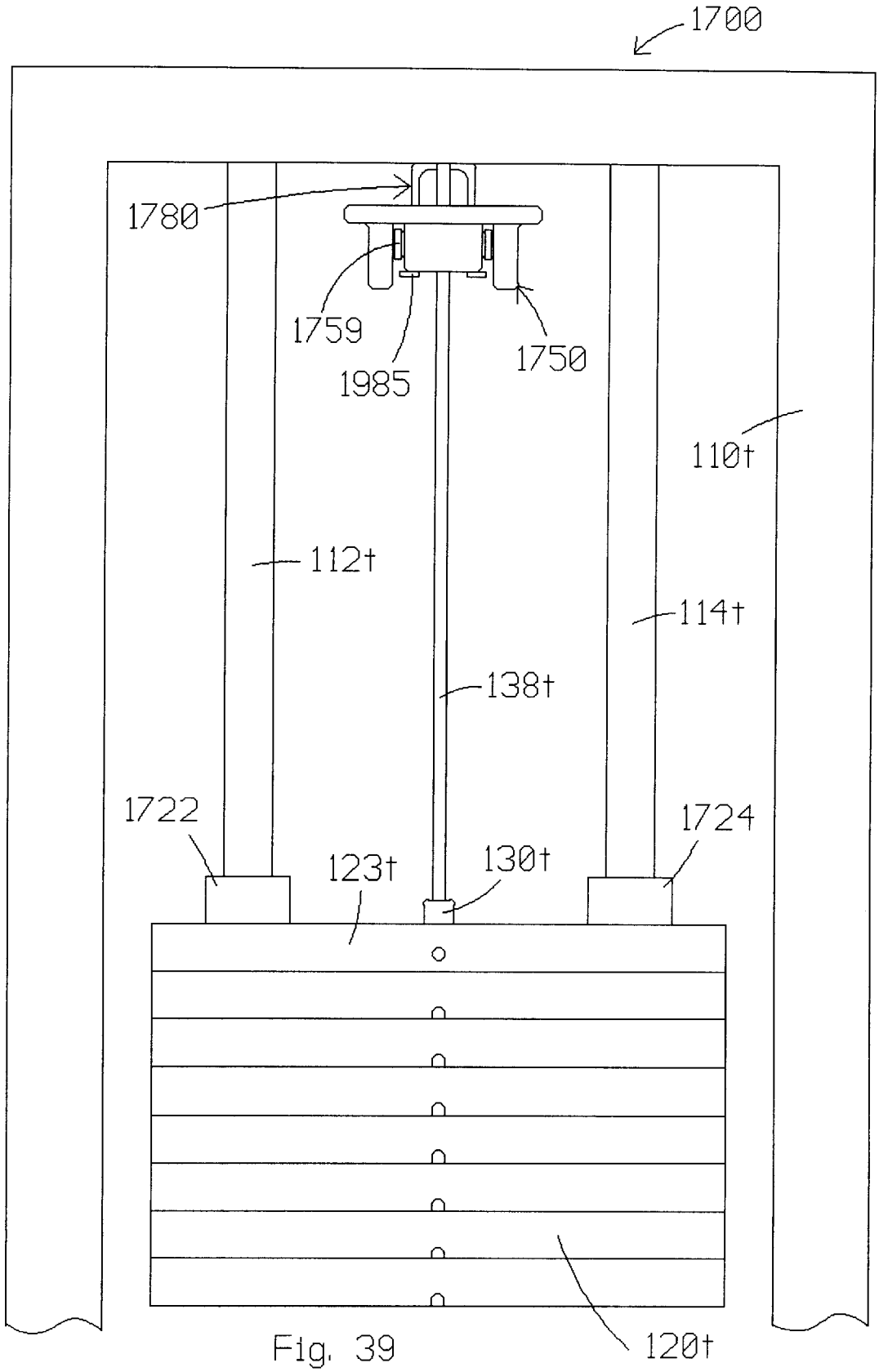
FIG. 39 is a partially fragmented, front view of a nineteenth exercise apparatus constructed according to the principles of the present invention.

FIG. 39 shows another weight stack machine 1700 which has been modified in accordance with the principles of the present invention. The machine 1700 includes a frame 110*t* designed to rest upon a floor surface. First and second guide rods 112*t* and 114*t* extend vertically between lower and upper ends of the frame 110*t*. A top plate 123*t* and underlying weight plates 120*t* are arranged in a vertical stack and movably mounted on the guide rods 112*t* and 114*t* by bushings 1722 and 1724 (or other suitable means known in the art). When not in use, the plates 123*t* and 120*t* rest against a shock absorbing member (not shown) on the lower end of the frame 110*t*.

A selector rod 130*t* extends through the plates 123*t* and 120*t*, is secured to the top plate 123*t*, and may be selectively connected to any desired plate 120*t* by a selector pin (or other suitable means known in the art). A cable 138*t* extends from an upper end of the selector rod 130*t* to one or more force receiving members which operate in a manner known in the art. As a result, movement of a force receiving member is resisted by gravity acting on the mass of the selected plates.

A supplemental weight 1750 is movably mounted on the connector 138*t*, above the top plate 123*t*. The weight 1750 is shown by itself in FIGS. 40–42 and 46–47. Although the weight 1750 could alternatively be formed as a single, unitary piece, the weight 1750 is made from complementary first and second pieces 1760 and 1770 to facilitate retrofit mounting of the weight 1750 on an intermediate portion of the connector 138*t* (without accessing either end thereof). The two pieces 1760 and 1770 are identical pieces of cast steel, and each weighs one-quarter of the weight of the plates in the stack 120*t*.

Each of the pieces 1760 and 1770 includes an upper plate portion 1761 or 1771, a central block portion 1762 or 1772, and opposite side wing portions 1763 or 1773, all of which cooperate to provide a configuration suitable for maneuvering the weight 1750 with a single hand. Both the block portions 1762 and 1772 and the wing portions 1763 and 1773 are rigidly connected directly to respective plate portions 1761 and 1772. Neck portions 1768 and 1778 are rigidly interconnected between respective wings portions 1763 or 1773 and block portions 1762 or 1772 in a manner which creates respective downwardly opening grooves 1767 and 1777 and interior passages 1769 and 1779. Registration pegs and openings are provided on opposing wing portions 1763 and 1773 to align the pieces 1760 and 1770 (as well as respective grooves 1767 and 1777 and passages 1769 and 1779) relative to one another.

An elongate slot 1757, having opposite side notches 1758, extends through the plate portions 1761 and 1771 and the block portions 1762 and 1772, perpendicular to the passages 1769 and 1779. The profile of the slot 1757 is approximately three times as long as it is wide, and the width of the slot 1757 is several times larger than the diameter of the connector 138*t*. The notches 1758 are diametrically opposed arcs of a circle having a diameter sufficiently large to accommodate both the selector rod 138*t* and the catch portion of a weight holder 1780 mounted on the frame 110*t* above the upper limit of the top plate 123*t*. With the connector 138*t* disposed inside the slot 1757 and the opposing registration structure aligned, flexible fasteners 1759 (sometimes referred to as cable ties) are inserted through respective passages 1769 and 1779 and formed into snug, closed loops about respective neck portions 1768 and 1778, and nested within respective grooves 1767 and 1777.

The weight holder 1780 is shown by itself in FIGS. 43–45. The weight holder 1780 may be described as a generally U-shaped piece of injection molded plastic having an upper base plate 1783 and opposite side legs or prongs 1784. The prongs 1784 extend away from the base plate 1783 in slightly divergent fashion and terminate in respective tabs 1785 which extend parallel to the base plate 1783 and away from one another. The outward surface 1786 of each prong 1784 has a radius of curvature similar to that of the notches 1758 in the supplemental weight 1750. The prongs 1784 are designed to resiliently deflect into and out of engagement with the notches 1758 as the supplemental weight 1750 is rotated about the weight holder 1780. The tabs 1785 are designed to underlie opposite sides of the block portions 1762 and 1772 when the prongs 1784 are rotated into engagement with the notches 1758 (as shown in FIG. 39), and to align with the slot 1757 when the prongs 1784 are rotated out of engagement with the notches 1758.

A hole 1788 extends through the center of the base plate 1783 to accommodate the connector 138*t*. A slot 1787 extends between the hole 1788 and an outside edge of the base plate 1783 to facilitate alignment of the holder 1780 with an intermediate portion of the connector 138*t* (without accessing either end). Circumferentially spaced holes 1789 extend through the base plate 1783 to facilitate mounting of the holder 1780 to an upper portion of the frame 110*t*.

As shown in FIG. 39, the weight holder 1780 supports the supplemental weight 1750 outside the path of the top plate 123*t*. The mass of the supplemental weight 1750 may be selectively added to the top plate 123*t* by rotating the supplemental weight 1750 approximately ninety degrees and lowering the supplemental weight 1750 downward along the connector 138*t* and on top of the top plate 123*t*. The wing portions 1763 and 1773 may be configured to straddle opposite sides of the top plate 123*t*, and/or the selector rod 130*t* may be configured to fit between the notches 1758 to limit movement of the supplemental weight 1750 relative to the top plate 123*t* and/or to maintain space between the supplemental weight 1750 and the guide rods 112*t* and 114*t*. Those skilled in the art will recognize that other alignment and/or registration methods may be used without departing from the scope of the present invention.

The present invention may also be described in terms of various methods. For example, the present invention provides a method of adjusting weight resistance to exercise, comprising the steps of providing a frame with a first guide rod and a second guide rod, and a radially extending, rigid support on each said guide rod; movably mounting a stack of primary weights on each said guide rod beneath each said support; movably connecting a first secondary weight to only the first guide rod, and a second secondary weight to only the second guide rod. Selectively maneuvering the first secondary weight out of engagement with the support on the first guide rod and downward onto an uppermost weight in the stack. Selectively maneuvering the secondary weight out of engagement with the support on the second guide rod and downward onto the uppermost weight in the stack. In this way, a user may selectively add the mass of either said secondary weight or the combined mass of each said secondary weight to the uppermost weight in the stack.

In accordance with another method, a frame is provided with first and second guide rods, each having a support extending radially therefrom proximate an upper end thereof; a stack of primary weights is movably mounted on both of the guide rods beneath each said support; a first supplemental weight is movably connected to the first of the guide rods, and a second supplemental weight is movably connected to the second of the guide rods; the first supplemental weight is selectively moved from a first location, overlying a respective support, to a second location, beneath the respective support and within a path traversed by an uppermost weight in the stack; the second supplemental weight is selectively moved from a first location, overlying a respective support, to a second location, beneath the respective support and within the path traversed by the uppermost weight in the stack. As a result, the individual mass of either said supplemental weight, as well as the combined mass of each said supplemental weight, is available to be added to the uppermost weight in the stack.

Yet another method involves providing a frame with a first guide rod, a second guide rod, and at least one rigid support proximate an upper end of each said guide rod; a stack of primary weights is movably mounted on both the first guide rod and the second guide rod beneath each said rigid support; a first supplemental weight is movably connected to only the first guide rod, and a second supplemental weight is movably connected to only the second guide rod; the first supplemental weight is selectively maneuvered, independent of the second supplemental weight, relative to the first guide rod, out of engagement with the rigid support, and downward toward an uppermost weight in the stack; the second supplemental weight is selectively maneuvered, independent of the first supplemental weight, relative to the second guide rod, out of engagement with the rigid support, and downward toward the uppermost weight in the stack.

According to still another method of adjusting weight resistance to exercise, a frame is provided with a first guide rod having a first rigid support which is rigidly secured to the first guide rod and extends radially outward from the first guide rod, and with a second guide rod having a second rigid support which is rigidly secured to the second guide rod and extends radially outward from the second guide rod; a stack of weight plates, including a top plate, is mounted on both the first guide rod and the second guide rod for movement between a lowermost position and an uppermost position beneath both the first rigid support and the second rigid support; a connector is interconnected between a force receiving member and a desired number of plates in the stack; a first supplemental weight is mounted on at least the first guide rod for movement along the first guide rod, and a second supplemental weight is mounted on at least the second guide rod for movement along the second guide rod; the first supplemental weight is selectively maneuvered from a first upper position, resting on the first rigid support, to a first lower position, disposed entirely beneath the first rigid support; the second supplemental weight is selectively maneuvered from a second upper position, resting on the second rigid support, to a second lower position, disposed entirely beneath the second rigid support.

According to yet another method, a frame is provided with an interior space bounded by a shield; a stack of weight plates, including a top plate, is movable relative to the frame between a lowermost position and an uppermost position inside the interior space; a connector is interconnected between a force receiving member, disposed outside the interior space, and a desired number of plates in the stack; a supplemental weight is disposed above the stack and movable relative to the frame between a first position and a second position inside the interior space, wherein the first position is above the uppermost position, and the second position is beneath the uppermost position; a handle is connected to the supplemental weight and movable relative to the frame between a first position and a second position outside the interior space; the handle is selectively moved from the first position to the second position outside the interior space in order to move the supplemental weight from the first position to the second position inside the interior space.

The present invention may also be described in terms of a method of providing a frame with a guide rod; providing a top weight plate movable along the guide rod between a lowermost position and an uppermost position; providing a supplemental weight above the top weight plate and movable from a first rest position to a second rest position, wherein the first rest position is above the uppermost position, and the second rest position is below the uppermost position; providing a connector extending through the supplemental weight and interconnected between the top weight plate and a force receiving member; selectively moving the supplemental weight from the first rest position to the second rest position in order to increase resistance to movement of the top weight plate to the uppermost position. An energy absorber may be provided in series between the top weight plate and at least a portion of the supplemental weight.

The foregoing method facilitates different modes of exercise under different circumstances. For example, the moving step may involve lowering the supplemental weight onto the top plate, in which case the weight resistance is incrementally increased throughout the range of exercise motion. As on other embodiments, the top plate and the supplemental weight may be provided with complementary portions, such that the moving step brings the complementary portions into engagement with one another. In the alternative, the moving step may involve freeing the supplemental weight from the frame at the first rest position and securing the supplemental weight to the frame at the second rest position, in which case the weight resistance increases incrementally during the exercise stroke. The supplemental weight and the frame may be provided with complementary portions, such that the moving step brings the complementary portions into engagement with one another. Moreover, the top plate and the supplemental weight may be provided with complementary portions, such that movement of the top plate toward the uppermost position brings the complementary portions into engagement with one another. Furthermore, the location of the second rest position may be selectively adjusted relative to the top plate.

Another method involves the provision of a frame with a guide rod, a top weight plate movable along the guide rod between a lowermost position and an uppermost position, and a connector interconnected between the top weight plate and a force receiving member. A supplemental weight is provided on the frame at a rest position above the top weight plate and below the uppermost position. Force is exerted against the force receiving member to move the top weight plate upward from the lowermost position, into contact with the supplemental weight, and upward beyond the rest position. An energy absorber may be provided in series between the top weight plate and at least a portion of the supplemental weight. The method may further involve selective movement of the supplemental weight to a removed position, supported by the frame above the uppermost position. The interengaging members may be provided with complementary portions, and/or the rest position may be selectively adjusted, as in the previous method.

Another method involves movably mounting a stack of weights on a frame, so that a top plate is movable along a path relative to the frame; interconnecting a flexible member between the top plate and the frame; and movably connecting a supplemental weight to an intermediate portion of the flexible member for movement between an inactive position, supported by the frame outside the path of the top plate, and an active position, disposed within the path of the top plate.

Yet another method may be described in terms of improving an exercise apparatus of the type having a stack of weights movably mounted on a frame, including a top plate which is movable along a path, comprising the steps of providing first and second members which cooperate to form a supplemental weight having an internal opening sufficiently large to encompass an elongate member on the apparatus which extends parallel to the path of the top plate; interconnecting the first and second weight members about the elongate member; providing a catch on the frame to support the supplemental weight outside the path of the top plate; and selectively freeing the supplemental weight from the catch and moving the supplemental weight into the path of the top plate.

Still another method may be described in terms of adjusting resistance on an exercise apparatus of the type having a stack of weights movably mounted on a frame, including a top plate which is movable along a path, comprising the steps of providing at least one guide rod on the frame; movably mounting the stack of weights on the guide rod in such a manner that the top plate in the stack is movable along a path; interconnecting a flexible member between the top plate and an upper portion of the frame; constraining a supplemental weight to move along at least one of the flexible member and the at least one guide rod; providing a support on the frame to support the supplemental weight in an inactive position above the path of the top plate; and requiring a user to maneuver the supplemental weight out of engagement with the support for downward movement into an active position within the path of the top plate.

The present invention may also be described in terms of an exercise apparatus, comprising a frame having a guide rod; a top weight plate movably connected to the guide rod; a connector interconnected between the top weight plate and a force receiving member; and a supplemental weight movably connected to the connector and alternately supported by the frame and the top weight plate. The connector moves relative to the supplemental weight when the latter is supported by the frame, and the supplemental weight moves together with the connector and the top weight plate when the supplemental weight is supported by the latter.

The present invention may also be described in terms of an exercise apparatus, comprising a frame having a guide rod; a top weight plate movably mounted on the guide rod; a connector interconnected between the top weight plate and a force receiving member; a supplemental weight disposed above the top weight plate and forming a substantially closed loop about the connector; and a means for selectively combining the supplemental weight and the top weight plate. The means supports the supplemental weight at a distance above the top weight plate in a first mode of operation, and the means allows the supplemental weight to be supported by the top weight plate in a second mode of operation.

The present invention may also be described in terms of an exercise apparatus, comprising a frame; a stack of weights movably mounted on the frame, wherein the stack includes a top plate which is movable along a path; and a supplemental weight movable into and out of the path of the top plate, wherein a boss on the supplemental weight registers with a recess in the top plate when the supplemental weight is disposed on top of the top plate.

The present invention may also be described in terms of an exercise apparatus, comprising a frame; a stack of weights movably mounted on the frame, wherein the stack includes a top plate which is movable along a path; a supplemental weight; and a handle connected to the supplemental weight to facilitate maneuvering of the supplemental weight into and out of the path of the top plate.

The present invention may also be described in terms of an exercise apparatus, comprising a frame; a stack of weights movably mounted on the frame, wherein the stack includes a top plate which is movable along a path; a flexible member extending upward from the top plate to an upper portion of the frame; and a supplemental weight connected to the flexible member and selectively movable into and out of the path of the top plate.

The foregoing description and/or the claims set forth below use certain terms which should be construed along the following lines to the extent necessary to overcome any relevant prior art. The lowermost and uppermost positions of the top plate in the weight stack are defined with reference to all parts and/or portions which are rigidly secured thereto. The space defined between these positions is bordered vertically by the positions themselves and horizontally by the planform of the top plate. The substantially fixed path which is said to be traversed by the supplemental weight(s) is limited in length to the height of the machine and includes the lowermost and uppermost positions of the top plate. The substantially closed loop which is said to be formed about the cable and/or one or more guide rods includes any closed curve not having a break or gap greater in width than the part(s) enclosed within the curve.

The foregoing description references specific embodiments and methods but will enable those skilled in the art to recognize additional improvements, combinations, and/or applications. For example, the supplemental weights may be secured to the frame and/or to the top plate by other arrangements which nonetheless incorporate the essence of the present invention. Moreover, one or more features of a particular embodiment may be suitable for use on another embodiment, either alone or in combination with features from still other embodiments. In view of the foregoing, the scope of the present invention is to be limited only to the extent of the following claims.

What is claimed is:

1. A method of adjusting resistance on an exercise apparatus of the type having a stack of weights movably mounted on a frame, including a top plate which is movable along a path, comprising the steps of:

providing a frame including at least one guide rod;

movably mounting the stack of weights on the at least one guide rod in such a manner that the top plate in the stack is movable along a path;

routing a flexible member between the top plate and an upper portion of the frame;

constraining a supplemental weight to move along at least one of the flexible member and the at least one guide rod;

providing a support on the frame to support the supplemental weight in an inactive position above and beyond the path of the top plate; and requiring a user to move at least a portion of the supplemental weight in a direction transverse to the at least one guide rod in order to free the supplemental weight from the support for downward movement into an active position within the path of the top plate.

2. The method of claim 1, wherein the supplemental weight is configured and arranged to accommodate passage of the flexible member through the center of mass of the supplemental weight.

3. The method of claim 1, wherein two guide rods are provided on the frame, and the stack of weights is movably mounted on both guide rods, and the supplemental weight is movably mounted on both guide rods.

4. The method of claim 3, wherein the flexible member is arranged to intersect the midpoint of a line segment drawn perpendicularly between the two guide rods.

5. The method of claim 3, wherein the user is required to pivot the supplemental weight about one of the guide rods in order to free the supplemental weight from the support.

6. The method of claim 1, wherein two guide rods are provided on the frame, and the stack of weights is movably mounted on both guide rods, and the supplemental weight is configured and arranged to form a substantially closed loop about each of the guide rods.

7. The method of claim 6, wherein the supplemental weight is configured and arranged to more closely bound a first of the guide rods and less closely bound a second of the guide rods.

8. The method of claim 7, wherein the supplemental weight and the top plate are configured to register with one another.

9. The method of claim 1, further comprising the steps of providing a shroud on the frame, and providing a slot in the shroud to facilitate user access to the supplemental weight.

10. The method of claim 1, further comprising the step of providing a handle on the supplemental weight to facilitate user movement of the supplemental weight.

11. A method of adjusting resistance on an exercise apparatus of the type having a stack of weights movably mounted on a frame, comprising the steps of:

providing a frame with first and second guide rods;

movably mounting a stack of weights on both said guide rods in such a manner that a top plate in the stack is movable along a path;

movably mounting a supplemental weight on both said guide rods;

providing a support on the frame to support the supplemental weight in an inactive position above and beyond the path of the top plate; and requiring a user to move at least a portion of the supplemental weight transversely relative to the guide rods in order to free the supplemental weight from the support for downward movement into an active position within the path of the top plate.

12. The method of claim 11, further comprising the steps of providing a shroud on the frame, and providing slot in the shroud to facilitate user access to the supplemental weight.

13. The method of claim 11, further comprising the step of providing a handle on the supplemental weight to facilitate user movement of the supplemental weight.

14. An exercise apparatus, comprising:

a frame;

a stack of weights movably mounted on the frame, wherein the stack includes a top plate which is movable along a path;

a supplemental weight; and a handle connected to the supplemental weight to facilitate maneuvering of the supplemental weight into and out of the path of the top plate;

wherein the frame defines an interior space bounded on at least one side by a shield with the supplemental weight constrained in the interior space and the handle on the opposite side of the shield from the supplemental weight.

15. The exercise apparatus of claim 14, wherein the handle is rigidly connected to the supplemental weight.

16. The exercise apparatus of claim 14, wherein the handle is rigidly connected to the supplemental weight and projects through a slot in the shield.

17. The exercise apparatus of claim 14, wherein a flexible connector is interconnected between the handle and the supplemental weight, and an intermediate portion of the connector is routed about at least one guide on the frame.

18. The exercise apparatus of claim 14, wherein the handle and the shield cooperate to releasably support the supplemental weight in a position outside the path of the top plate.

19. The exercise apparatus of claim 14, wherein a flexible connector is interconnected between the handle and the supplemental weight, and an intermediate portion of the connector is routed about at least one guide on the frame.

20. The exercise apparatus of claim 14, wherein a catch is rigidly mounted on the frame outside the path of the top plate, and the supplemental weight is configured to overlap the catch when occupying a first position relative to the frame, and to be free of the catch when occupying a second position relative to the frame.

21. The exercise apparatus of claim 14, wherein the frame includes a guide rod extending through the stack of weights, and the supplemental weight forms a closed loop about the guide rod.

22. The exercise apparatus of claim 14, further comprising a second said supplemental weight and a second said handle connected to the second said supplemental weight.

23. The exercise apparatus of claim 14, further comprising a flexible member extending upward from the top plate to an upper portion of the frame, wherein the supplemental weight forms a closed loop about the flexible member.

* * * * *